US009055833B2

(12) United States Patent
Anderson

(10) Patent No.: US 9,055,833 B2
(45) Date of Patent: Jun. 16, 2015

(54) DRINKING MOUTHPIECE

(75) Inventor: Julia McKinley Anderson, Armadale (AU)

(73) Assignee: Smilestraw Pty Ltd. (AU)

( * ) Notice: Subject to any disclaimer, the term of this patent is extended or adjusted under 35 U.S.C. 154(b) by 0 days.

(21) Appl. No.: 13/700,177

(22) PCT Filed: May 27, 2011

(86) PCT No.: PCT/AU2011/000644

§ 371 (c)(1),
(2), (4) Date: Feb. 8, 2013

(87) PCT Pub. No.: WO2011/146999

PCT Pub. Date: Dec. 1, 2011

(65) Prior Publication Data

US 2013/0200029 A1 Aug. 8, 2013

Related U.S. Application Data

(60) Provisional application No. 61/364,788, filed on Jul. 15, 2010.

(30) Foreign Application Priority Data

May 28, 2010 (AU) ..... 2010902356
Mar. 21, 2011 (AU) ..... 2011901042

(51) Int. Cl.
*A61J 11/00* (2006.01)
*A61J 15/00* (2006.01)
*A47G 21/18* (2006.01)

(52) U.S. Cl.
CPC ..... *A47G 21/185* (2013.01); *A61J 11/0035* (2013.01); *A61J 15/0011* (2013.01); *A61J 11/00* (2013.01)

(58) Field of Classification Search
CPC ..... A61J 11/00; A61J 11/004; A61J 11/045; A61J 11/007; A61J 11/0075; A47G 21/185
USPC ..... 215/11.1–11.6; 128/861; 606/234–236; 239/33; 222/490
See application file for complete search history.

(56) References Cited

U.S. PATENT DOCUMENTS 1,012,980 A * 12/1911 Brophy ..... 215/11.1
1,045,456 A * 11/1912 Tatum ..... 215/11.1

(Continued)

FOREIGN PATENT DOCUMENTS

AU 2003100795 B4 12/2003
AU 2005202882 A1 1/2007

(Continued)

OTHER PUBLICATIONS

Saravanamuthu Ponnampalam; International Search Report; International Application No. PCT/AU2011/000644; Jun. 21, 2011; Australian Patent Office.

(Continued)

*Primary Examiner* — Mickey Yu
*Assistant Examiner* — Gideon Weinerth
(74) *Attorney, Agent, or Firm* — Stevens & Showalter LLP

(57) ABSTRACT

A drinking mouthpiece comprising a resilient body through which fluid flows from a rear opening through to a front opening, the body having a contoured longitudinal upper profile for lying against a portion of the palate of a mouth and a contoured longitudinal lower profile for lying against a tongue; wherein a forward end of the mouthpiece near the front opening has a cross-sectional profile that tapers to two opposing sides of the mouthpiece, and also has a bulging area on the lower profile that provides a reference point against which the tongue can lie.

20 Claims, 20 Drawing Sheets

(56) References Cited

U.S. PATENT DOCUMENTS

| | | | | | |
|---|---|---|---|---|---|
| 1,207,120 | A | * | 12/1916 | Younker | 215/11.1 |
| 1,590,152 | A | * | 6/1926 | Dreyfus | 215/11.1 |
| 2,366,214 | A | * | 1/1945 | Ramaker | 215/11.1 |
| 2,520,773 | A | * | 8/1950 | Muller | 215/11.1 |
| 2,537,583 | A | * | 1/1951 | Griesinger | 215/11.1 |
| 2,816,547 | A | * | 12/1957 | Adisman | 215/11.1 |
| 3,070,249 | A | * | 12/1962 | Schrwald | 215/11.1 |
| 3,082,770 | A | * | 3/1963 | Straub | 215/11.1 |
| 3,130,725 | A | * | 4/1964 | Griesinger | 215/11.1 |
| 3,777,753 | A | * | 12/1973 | Kesselring et al. | 215/11.1 |
| 3,924,621 | A | * | 12/1975 | Cassimally | 606/236 |
| D262,575 | S | * | 1/1982 | Araujo, Jr. | D24/196 |
| 4,403,613 | A | * | 9/1983 | Panicci | 606/236 |
| 4,632,263 | A | * | 12/1986 | Gertzman | 215/11.1 |
| D288,240 | S | * | 2/1987 | Fuller | D24/196 |
| 4,676,386 | A | * | 6/1987 | Phlaphongphanich | 215/11.1 |
| 4,834,099 | A | * | 5/1989 | Schrooten | 215/11.1 |
| 4,856,663 | A | * | 8/1989 | Epp | 215/11.1 |
| 5,004,473 | A | * | 4/1991 | Kalantar | 606/234 |
| 5,078,733 | A | * | 1/1992 | Eveleigh et al. | 606/236 |
| 5,133,740 | A | * | 7/1992 | Kussick | 606/236 |
| 5,810,000 | A | * | 9/1998 | Stevens | 128/200.26 |
| 5,814,074 | A | * | 9/1998 | Branam | 606/234 |
| 5,871,118 | A | | 2/1999 | Franzese | |
| 5,922,010 | A | * | 7/1999 | Alanen et al. | 606/236 |
| 6,080,186 | A | * | 6/2000 | Pedersen et al. | 606/234 |
| 6,736,830 | B2 | * | 5/2004 | Roust | 606/234 |
| 6,773,451 | B1 | * | 8/2004 | Dussere | 606/235 |
| 7,029,491 | B2 | * | 4/2006 | Davis | 606/234 |
| 7,578,403 | B2 | * | 8/2009 | Tamura et al. | 215/11.1 |
| 7,731,733 | B2 | * | 6/2010 | Tesini et al. | 606/236 |
| 7,931,672 | B2 | * | 4/2011 | Tesini et al. | 606/236 |
| 8,252,023 | B2 | * | 8/2012 | Moses et al. | 606/234 |
| 8,403,158 | B2 | * | 3/2013 | Itzek | 215/11.6 |
| D690,823 | S | * | 10/2013 | D'Alesio | D24/194 |
| 8,568,351 | B2 | * | 10/2013 | Thalab | 604/77 |
| 8,833,575 | B2 | * | 9/2014 | Fave-Lesage | 215/11.4 |
| 2003/0034031 | A1 | * | 2/2003 | Lev et al. | 128/200.24 |
| 2003/0163162 | A1 | * | 8/2003 | Uehara et al. | 606/234 |
| 2003/0181947 | A1 | * | 9/2003 | Struckmeier et al. | 606/234 |
| 2004/0220618 | A1 | * | 11/2004 | Rohrig | 606/234 |
| 2006/0011572 | A1 | * | 1/2006 | Pegg | 215/11.1 |
| 2007/0112386 | A1 | * | 5/2007 | Branam | 606/234 |
| 2010/0268276 | A1 | * | 10/2010 | Du Chesne et al. | 606/236 |
| 2011/0100944 | A1 | * | 5/2011 | Van Der Kooi et al. | 215/11.1 |
| 2011/0106156 | A1 | * | 5/2011 | Arbib | 606/234 |
| 2011/0130790 | A1 | * | 6/2011 | Hezari et al. | 606/234 |
| 2012/0277794 | A1 | * | 11/2012 | Kountotsis et al. | 606/234 |
| 2013/0060281 | A1 | * | 3/2013 | Lam | 606/234 |
| 2013/0123846 | A1 | * | 5/2013 | Guerra | 606/236 |
| 2013/0263864 | A1 | * | 10/2013 | von Treuenfels | 128/848 |

FOREIGN PATENT DOCUMENTS

| | | | |
|---|---|---|---|
| AU | 2009100923 | A4 | 10/2009 |
| EP | 1275366 | A2 | 1/2003 |

OTHER PUBLICATIONS

Van Bastelaere, Tiny; Communication pursuant to Rule 62 EPC; Supplementary European Search Report; European Application No. 11785926.4; Feb. 13, 2014; European Patent Office; Munich, Germany.

* cited by examiner (b) SECTION R–R (a)

SECTION T–T (b)

DRINKING MOUTHPIECE

The present invention relates to a drinking mouthpiece for drinking fluids, examples of such a mouthpiece including drinking straws and teats for babies and young children.

BACKGROUND

In terms of drinking straws, the co-ordination and strength of the jaw muscles, lips or tongue can weaken in elderly and sick people. This can make drinking difficult and can affect hydration and nutrition. Drinking straws have been used to mitigate this problem but use of straws presents other difficulties. Proper straw use requires the user to generate a seal around the straw with the lips and to generate sufficient suction to draw fluids up through the straw and into the mouth. This requirement can be difficult to achieve by those infirmed, disabled and/or in a weakened state.

In terms of teats, infants are born with a built-in reflex to drink from a nipple. Without any training or experience a baby has both the instinct and physical features of the mouth to drink from a breast. The natural drinking technique is characterised by the sealing of the mouth around the nipple and use of a peristaltic wave or stripping action of the tongue to draw milk.

It is common for parents to supplement or replace breast-feeding with bottle feeding. Typically, an artificial teat, somewhat resembling the shape of a natural nipple is used in combination with a milk bottle. There are several problems associated with use of artificial teats including:

a. A pumping action is required to use the teat which, unlike the peristaltic wave technique, does not always stimulate saliva. Saliva in the milk stream assists in effective digestion.
b. Drinking can be difficult, given the energy required to repetitively compress the teat with the tongue rather than suck a nipple.
c. The instinctual drinking technique does not work, and a new technique must be learnt over time.
d. It can be difficult for children to switch between a natural nipple and a teat as different techniques must be used.

Furthermore, air can become entrained in the milk which can cause colic.

A solution is required to assist delivery of fluids to adults, children and/or babies having difficulty with using regular implements for drinking or feeding.

SUMMARY OF THE INVENTION

In accordance with the present invention there is provided a drinking mouthpiece comprising a resilient body through which fluid flows from a rear opening through to a front opening, the body having a contoured longitudinal upper profile for lying against a portion of the palate of a mouth and a contoured longitudinal lower profile for lying against a tongue; wherein a forward end of the mouthpiece near the front opening has a cross-sectional profile that tapers to two opposing sides of the mouthpiece, and also has a bulging area on the lower profile that provides a reference point against which the tongue can lie.

In one embodiment and viewing the mouthpiece in cross-section, the lower profile at the bulging area transitions to the tapered opposed sides through concaved faces. These surfaces form a dished ramp profile that allows a tongue to lie against, and to pull and push against, during suction and swallowing.

In an embodiment, the bulging area is a raised protuberance that converges and tapers towards a tip of the mouthpiece. The raised protuberance transitions to reduce in width and height toward the front opening and can be likened to a semi-cone shape around which a tongue can conform to provide a better grip and seal on the mouthpiece. The bulkiest part of the raised protuberance/bulging area provides a reference point for the tongue to work against. The bulging area is defined by a thickening of the material of the resilient body. Further provided may be a ridge running along the top of the raised protuberance, which acts as a guide for the tongue and provides gripping and sealing means for the tongue. The distance between the largest part of the bulging area and the front opening is approximately 3 mm to 20 mm.

The front opening, in one embodiment, is located at a tip of the mouthpiece and, in a longitudinal direction of the mouthpiece, the front opening is laterally offset from the rear opening of the mouthpiece. When measured against a longitudinal axis centered along the rear opening, the front and rear openings in one embodiment are offset by 2 to 8 mm. In another embodiment the front and rear openings are offset by 5 to 6 mm.

In one embodiment the upper profile is shorter than the lower profile when measured between a tip of the mouthpiece and a laterally common predefined point. This is because the top profile, while curved to contour against the top palate of a mouth, is less contoured than the lower profile, which in addition to contours, also has a bulging area.

In one embodiment the opposing sides taper to a point. In this embodiment, the point has a radius of curvature of less than 1.0 mm, or alternatively less than 0.5 mm, or less than 0.25 mm.

Flexible flanges are provided in an embodiment at the opposing sides between the bulging area and the front opening. The flanges are slightly upturned and are preferably provided substantially along the length of the opposing sides between the bulging area and the front opening.

Different applications of the drinking mouthpiece include use as a teat or a spout or a straw or an attachment for a straw.

As a teat, the lower profile in cross-section of the teat between the opposing sides is substantially larger than the upper profile. The front opening of the teat includes one or more small apertures located on the lower profile below the opposing sides and at the very tip of the teat.

As a teat or attachment for a straw, the mouthpiece is provided at the rear opening with an attachment profile to respectively attach to a bottle or to a straw.

BRIEF DESCRIPTION OF THE DRAWINGS

Embodiments of the present invention will now be described by way of example with reference to the accompanying drawings in which.

DETAILED DESCRIPTIONS OF EMBODIMENTS

The drinking mouthpiece of the present invention addresses the need to improve the peristaltic-sucking cycle in infants feeding from a teat and in children and adults drinking from a spout or straw. The present mouthpiece achieves this by two main functions: by creating an effective seal around the mouthpiece; and minimising the upward force exerted by the tongue to maintain the mouthpiece in a sealed position thereby freeing the tongue to move in the peristaltic-sucking cycle to draw in fluids and swallow.

Seals around the mouthpiece are created at the anterior of the mouth where the tongue and lips seal around the mouthpiece, and at the roof/palate of the mouth where the tongue seals the mouthpiece across the palate and the side gums. Once the mouthpiece is securely and relatively effortlessly held in the mouth, the median of the tongue can work to draw fluids into the mouth.

A resilient body of the present drinking mouthpiece together with longitudinal and lateral contoured profiles enhance the sealing effect of the mouthpiece against the palate by being shaped to roughly conform against the roof of the mouth cavity and having the flexibility to conform further still against the palate shape.

Toward a forward end of the mouthpiece, which is adapted to lie against the palate of the mouth, the mouthpiece in lateral cross-section assumes an elliptical shape, which varies from slightly elliptical to prominently elliptical depending on the application of the mouthpiece, and tapers to two opposing sides of the mouthpiece, which demarcate an upper contoured profile from a lower contoured profile. The tapering opposing sides assist with correctly sealing the mouthpiece in the mouth.

Furthermore, a bulging area on the underside of the mouthpiece, namely on the lower contoured profile, provides a reference point against which the tongue can lie. From this point the tongue can more easily work the mouthpiece to effectively draw in fluids and move in the peristaltic-sucking cycle.

The drinking mouthpiece is embodied in various forms including a baby's teat, a straw or straw attachment, or a spout. In the embodiments described herein reference is made to a drinking straw attachment and to a baby's teat.

Figure 1:
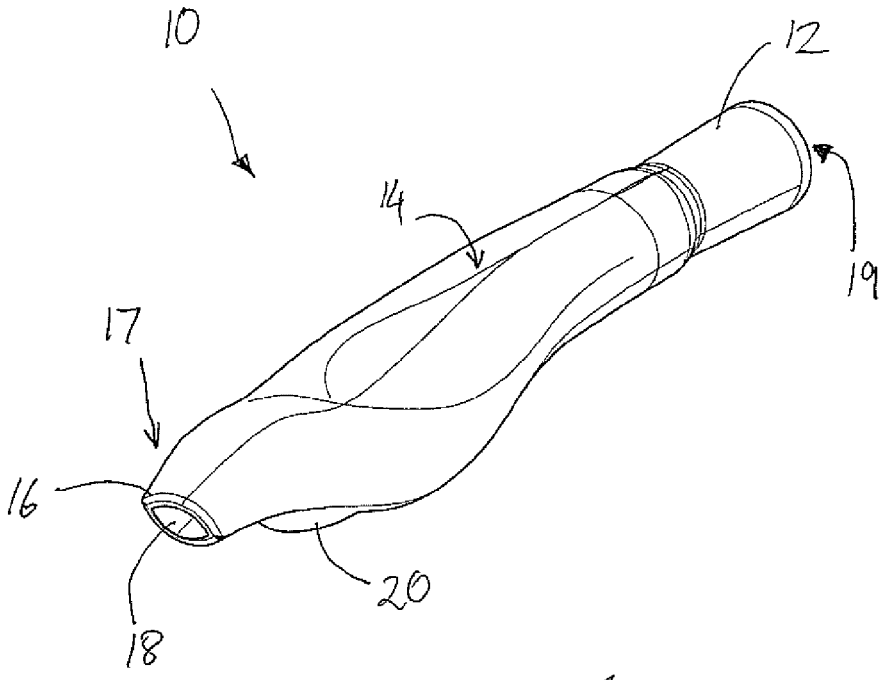
FIG. 1 is an upper perspective view of a drinking mouthpiece in accordance with a first embodiment of the present invention.
Figure 2:
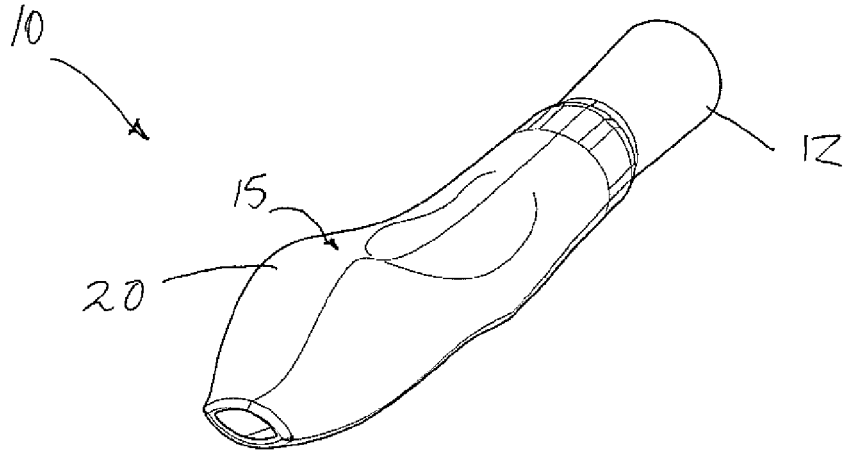
FIG. 2 is a lower perspective view of the mouthpiece of FIG. 1.
Figure 3:
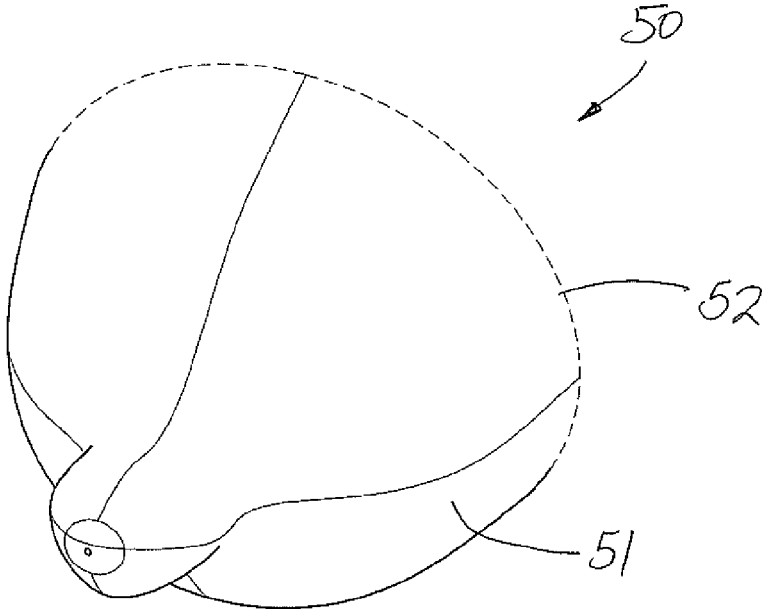
FIG. 3 is an upper perspective view of a second embodiment of a drinking mouthpiece.
Figure 4:
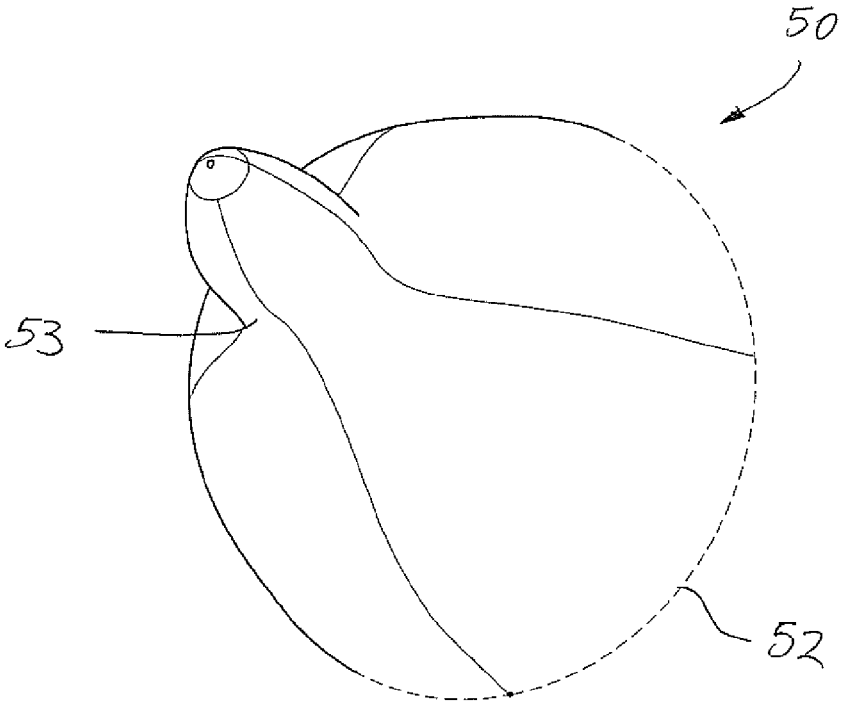
FIG. 4 is a lower perspective view of the mouthpiece of FIG. 3.
Figure 5A:
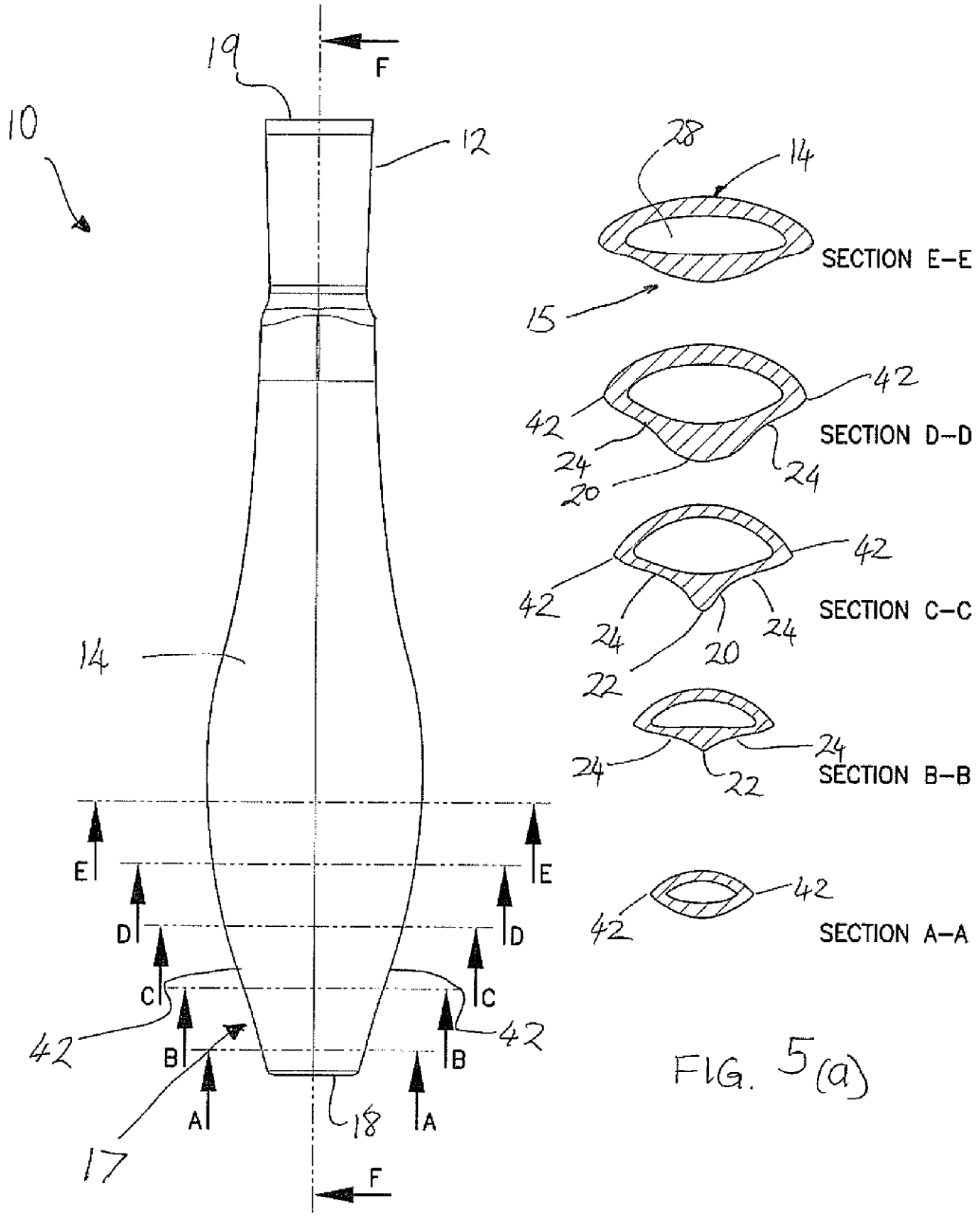
FIGS. 5(*a*) and 5(*b*) are a top view and a front view respectively of the mouthpiece of the first embodiment, and include views taken at sections A-A, B-B, C-C, D-D and E-E of FIG. 5(*a*)
Figure 5B:
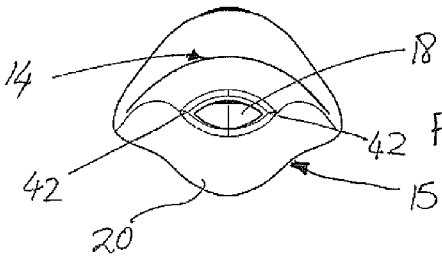
Figure 6:
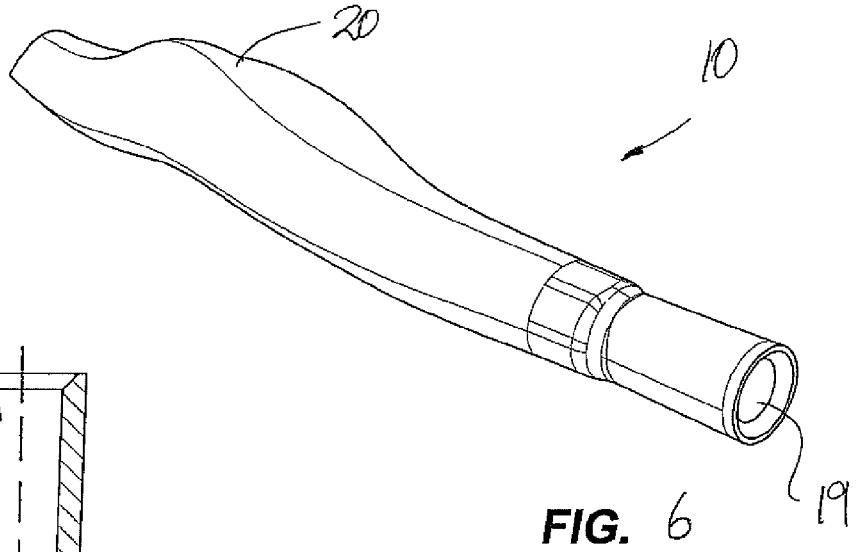
FIG. 6 is a rear perspective view of the mouthpiece of the first embodiment.
Figure 18:
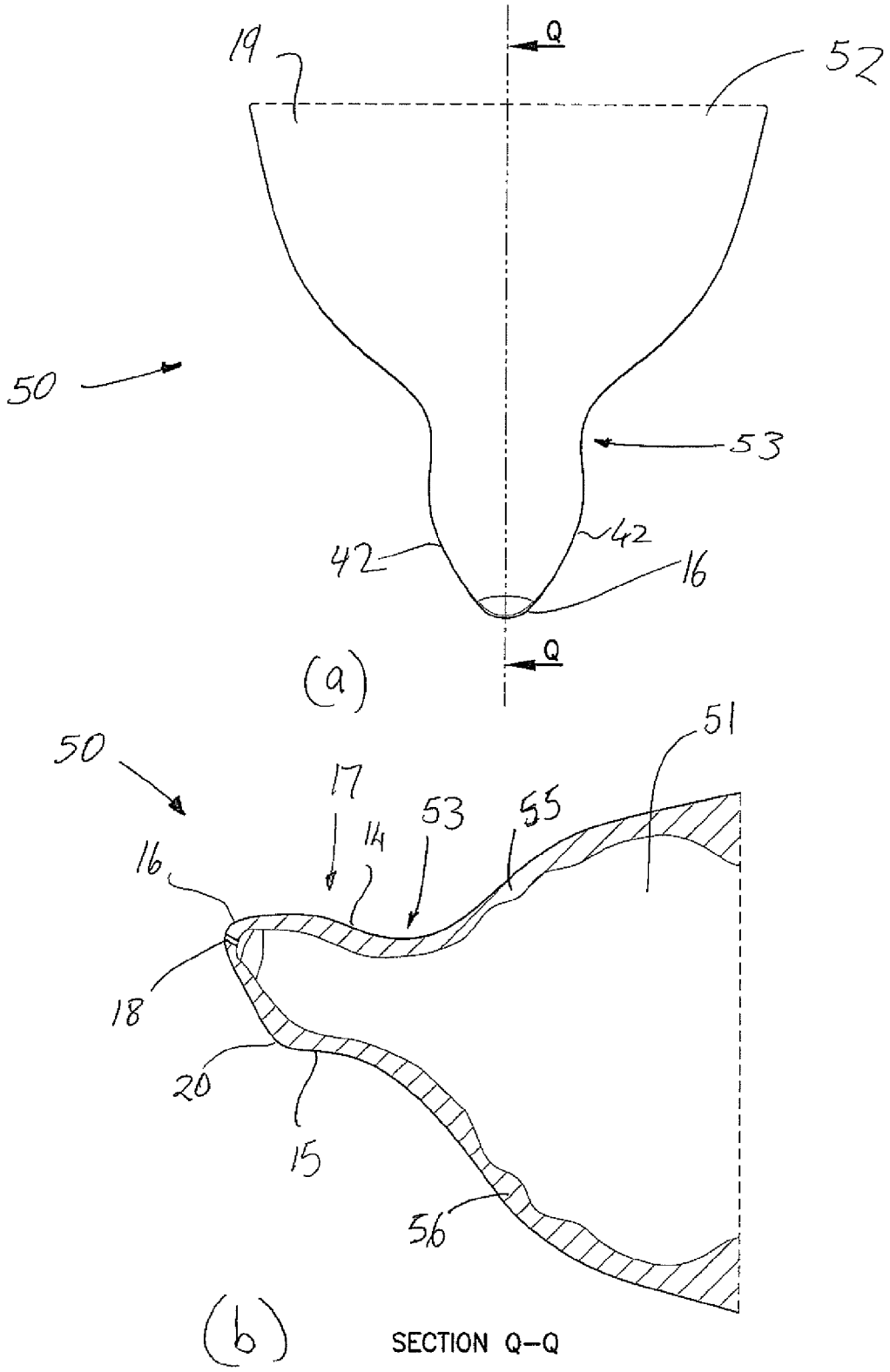
FIGS. 18(*a*) and 18(*b*) respectively illustrate the second embodiment of the mouthpiece in plan view and side sectional view taken at Q-Q of FIG. 18(*a*)

FIGS. 1, 2, 5(*a*)-17 illustrate various embodiments of the mouthpiece as a drinking straw attachment, while FIGS. 3, 4, 18(*a*)-30 illustrate embodiments of the mouthpiece as a baby's feeding teat.

FIGS. 1, 2, 5(*a*) to 10 illustrate a drinking mouthpiece in a first embodiment as a straw attachment 10. The straw attachment 10 has an enlarged neck 12 designed for attachment to a standard drinking straw (not shown). In an alternative embodiment the mouthpiece itself may form the entire drinking straw.

The drinking mouthpiece 10 illustrated finds particular usefullness with for the elderly or sick, but may be used by anyone and for example, by people who wish to reduce the exposure of their teeth to acids and sugars in drinks or by people wishing to avoid exposing their teeth to beverages that may stain, such as tea.

The straw attachment 10 is an elongated resilient body having a channel 28, a forward end 17 with a front opening 18 and a rear opening 19 at the neck 12. The inner diameter of neck 12 is stepped to receive a straw. The length of the neck 12 is tapered to open up to a wider diameter, and is sufficiently resilient, to allow the neck to receive straws of varying diameter. Alternatively, the neck can have varying stepped diameters to receive straws of varying diameters.

Figure 9:
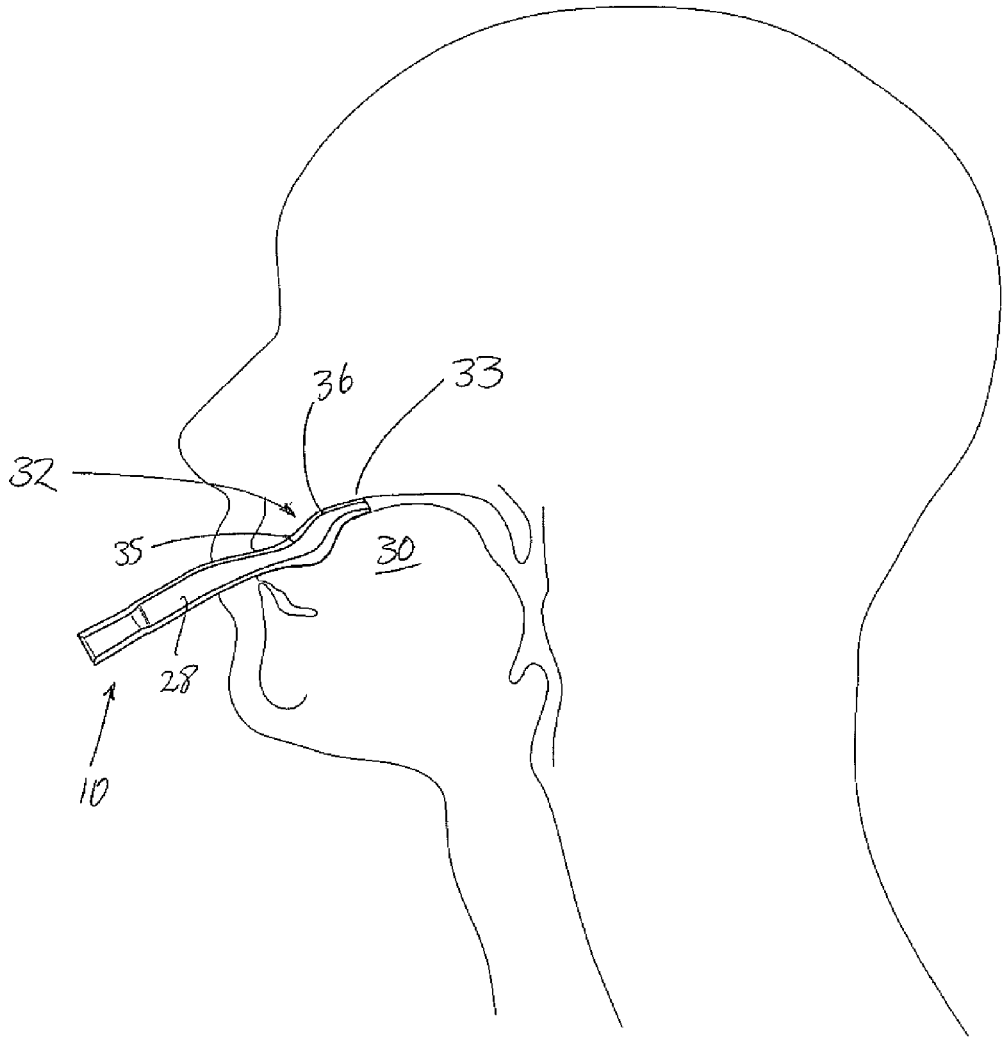
FIGS. 9 and 10 are a series of side sectional views showing the mouthpiece of the first embodiment inside a mouth which demonstrate a swallowing action.
Figure 10:
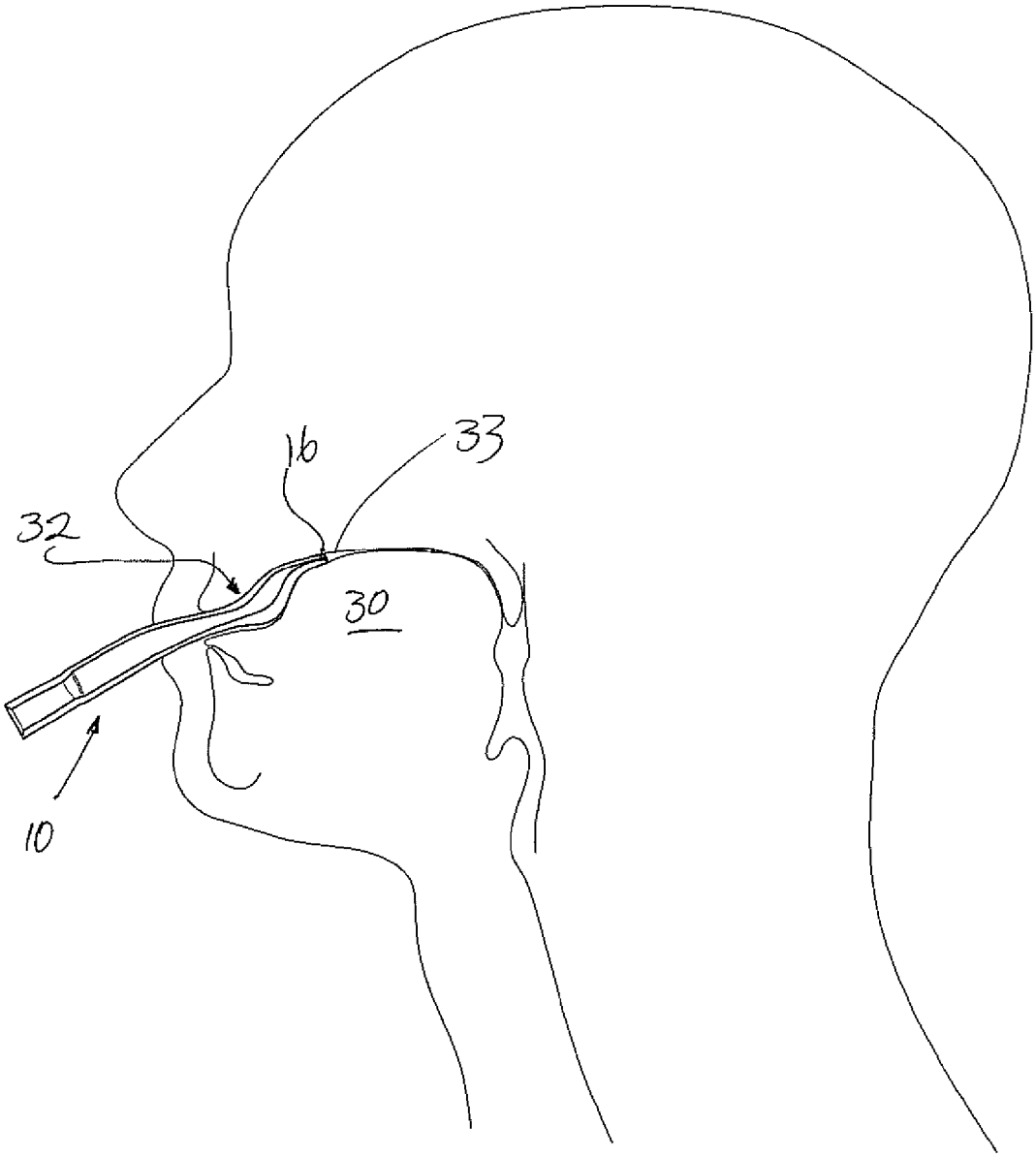
Figure 11:
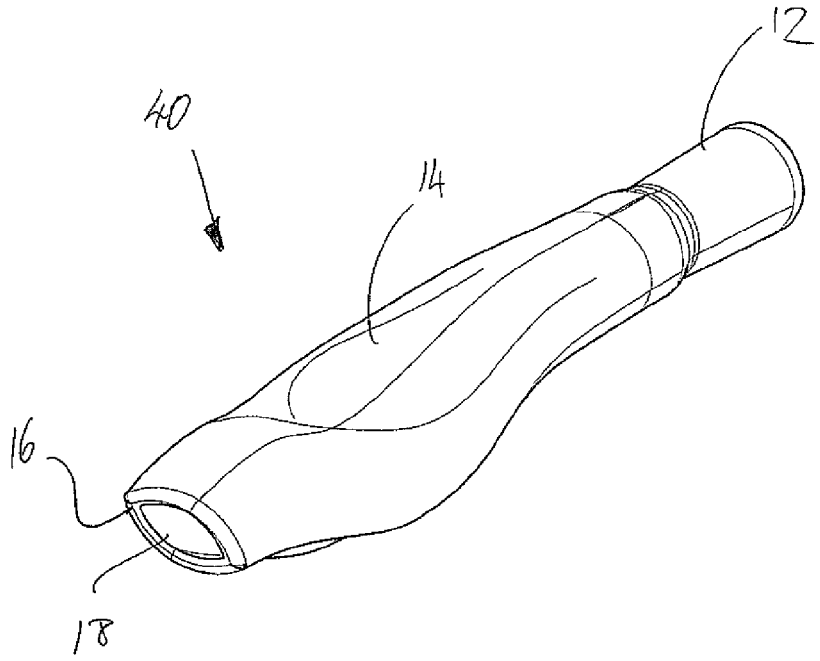
FIG. 11 is an upper perspective view of a third embodiment of a drinking mouthpiece.
Figure 12:
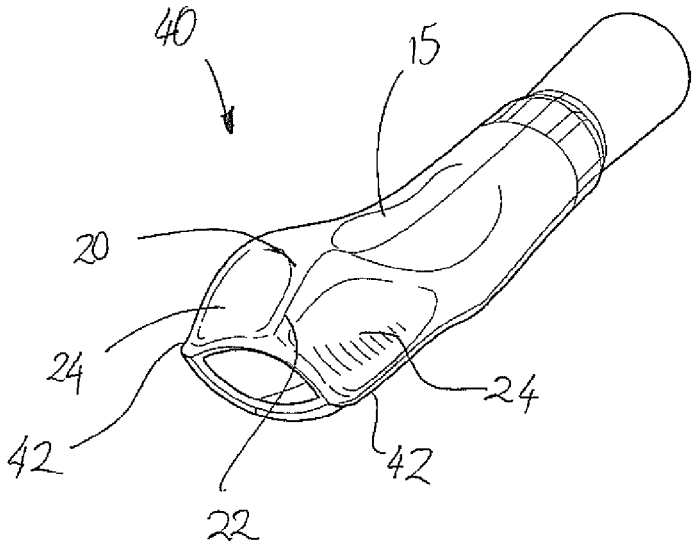
FIG. 12 is a lower perspective view of the mouthpiece of the third embodiment.
Figure 13:
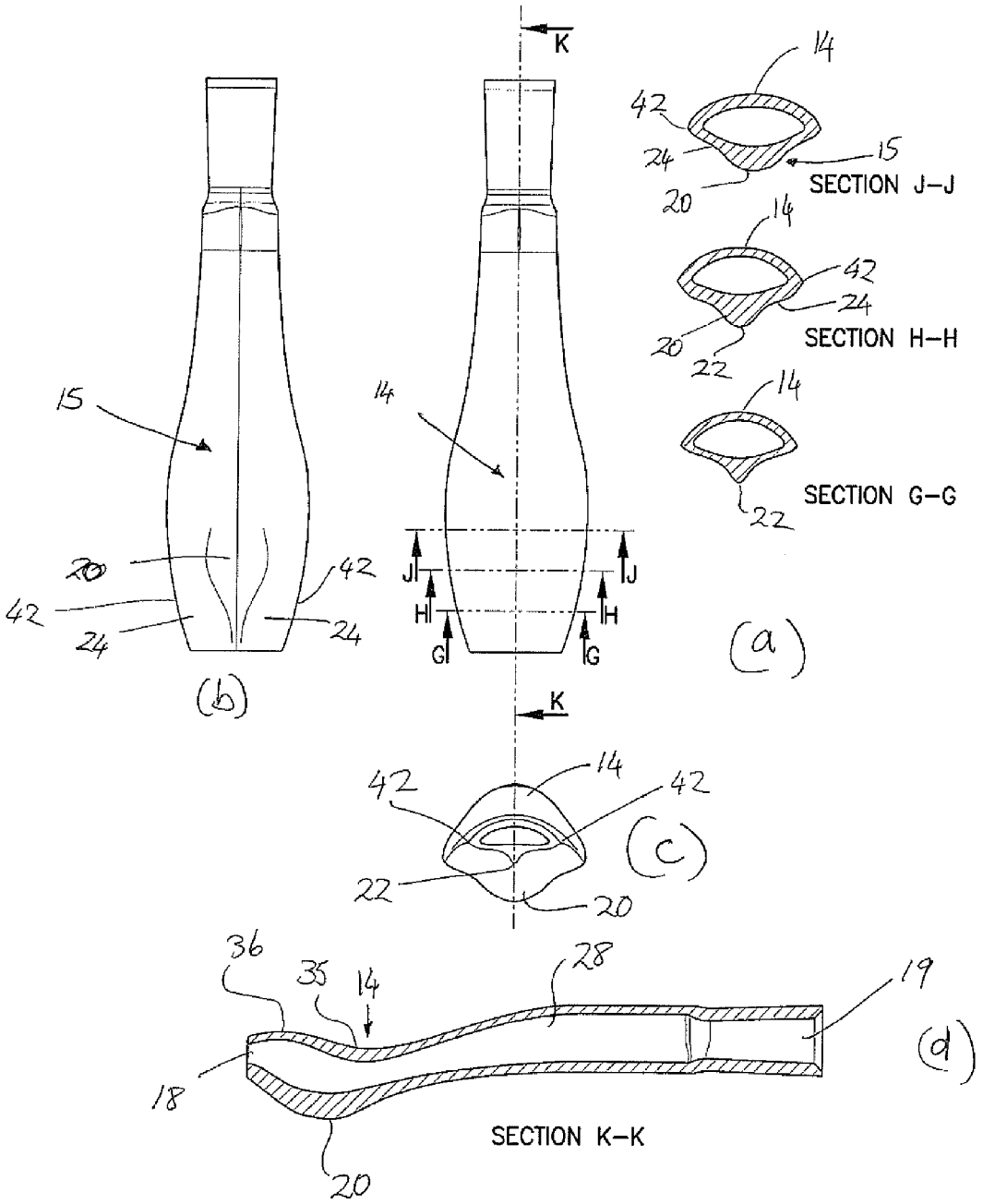
FIGS. 13(*a*) to 13(*d*) are respectively a plan view, an underneath view, a front view and a side sectional view of the mouthpiece of the third embodiment, and include views taken at sections J-J, H-H and G-G of FIG. 13(*a*)

The first embodiment of the straw attachment 10 described above is designed to sit deeper in the mouth than a regular straw to deliver fluid directly to the posterior of the mouth. The mouthpiece terminates at the posterior region of the mouth near the back molars or towards the junction of the hard and soft plates as illustrated in FIGS. 9 and 10.

A variation of the straw attachment is illustrated in FIGS. 11 to 14(*c*) as a shorter straw attachment 40 that sits in the mouth at the same depth as regular mouthpieces. The front opening of the shorter straw attachment 40 is consequently larger than the opening 40 of the first attachment 10.

A top (or upper) profile 14 of the straw attachments 10, 40 is contoured to lie against the hard palate and encourages correct and comfortable placement in the mouth. A bottom (or lower) profile 15 is also contoured to lie against the tongue and the bottom profile includes a bulging area 20 that gives the tongue a point of reference on the mouthpiece and a point which the tongue can "hold onto" in order to achieve correct purchase of the mouthpiece.

Figure 7:
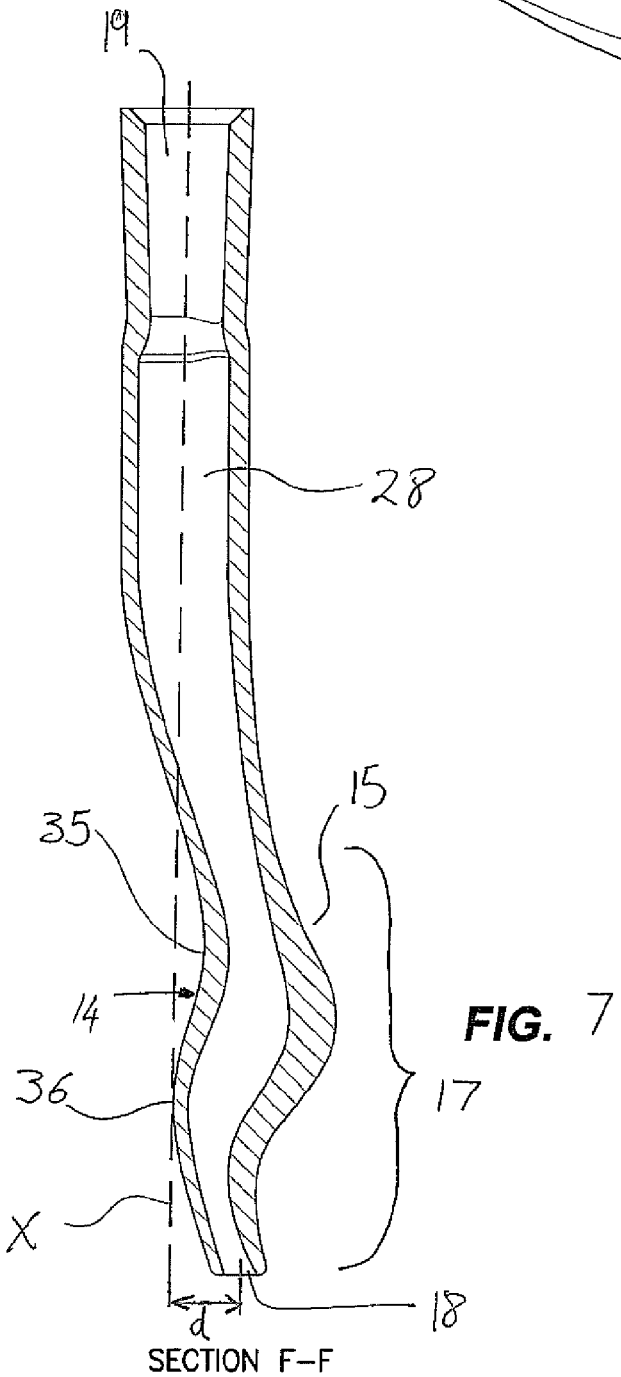
FIG. 7 is a side sectional view of the mouthpiece of the first embodiment.

The top profile 14 is shorter in length than the bottom profile 15, which is on the whole more bulbous or curved than top profile 14. Also, and as illustrated in FIG. 7, when measured against a longitudinal axis X that is centered longitudinally along the rear opening, the front and rear openings 18, 19 are offset to one another. The distance d of offset may be 2 mm to 8 mm, or even 5 mm to 6 mm. This offset feature ensures the straw attachment sits straight in the mouth, without folding channel 28 against a bottom lip.

The mouthpiece is made from a thin walled, soft, non-toxic and resilient material such as latex or silicone. The mouthpiece is resilient so that it returns to its original shape but also soft and flexible so that it can be easily manipulated and curved during use. Accordingly, the tongue can move or flex around the bulging area 20 and move innately and naturally around the bulging area during a drinking motion.

Conversely, if the bottom profile was flat with no bulging area the tongue would tend to remain flat against the palate reducing its movement and giving the tongue a featureless surface to work with. Or if the bottom profile had too large a bulging area this would tend to exert excessive downward pressure on the tongue and cause it to repeatedly move in a vertical up and down movement. Both scenarios can lead to tongue fatigue and unnecessary interruption whilst feeding or drinking.

As can specifically be seen in FIGS. 11 to 14(*c*) illustrating the shorter straw attachment 40, the bulging area 20 is a bulge, or a raised protuberance molded into the lower profile 15 to provide a continuous surface of the lower profile 15, that converges and tapers towards a tip 16 of the mouthpiece. The raised protuberance transitions to reduce in width and height toward the front opening 18 and can be likened to a semi-cone shape, or a partial tear-drop configuration when viewed in cross-section to a longitudinal direction of the body, e.g., as shown in FIG. 18*b*, around which a tongue can conform to better purchase and seal on the mouthpiece. The bulkiest part of the raised protuberance/bulging area provides a reference point for the tongue to work against and in one embodiment the radius of curvature of the bulging area is 5 to 10 mm, and more specifically 7 to 8 mm.

The distance between the largest part of the bulging area 20 and the front opening 18 is approximately 3 mm-20 mm, for an adult's straw/straw attachment. By setting the distance between the bulging area 20 and front opening 18 at a specified value, the bulge can sit in the median sulcus of the tongue and fluid will be delivered through the front opening 18 to a desired point in the mouth cavity.

The semi-cone shape of the raised protuberance acts somewhat as a funnel for the tongue in guiding the tongue longitudinally of the mouth to work in directing fluid exiting the mouthpiece back towards the pharynx along the median sulcus.

The bulge 20 is formed from a thickening of the resilient material forming the mouthpiece so that in a longitudinal direction the bulge transitions from the thickness of the bottom profile wall 26 into a thickened bulge and thins back out on the other side of the bulge to the wall thickness. This feature is best shown in the sectional view of FIGS. 7 and 13(*d*). By having a bulge 20 formed from a thickening of the mouthpiece material the channel 28 flows smoothly and substantially evenly through the mouthpiece without having divots or recesses at the location of the bulge.

Furthermore, the thickened bulge 20 is a fairly hard mass relative to the thin walls of the mouthpiece and therefore acts as a distinctive marker on the mouthpiece to which the tongue can identify and "hold on". Additionally, the mass in the bulge can prevent collapse or undesirable folding of the mouthpiece during use.

Either side of the bulging area 20, when viewed in a lateral cross-section such as shown in the sections taken at FIGS. 5(*a*) and 13(*a*), transitions through concave faces 24 to then taper towards opposite sides 42 of the mouthpiece 10, 40. These concaved faces 24 form a dished ramp profile that allows the tongue to lie against, and to pull and push against, during suction and swallowing. The concaved faces also assists in the tongue being able to seal the mouthpiece in the mouth cavity for effective swallowing. Specifically, during swallowing the concaved faces 24 allow the tongue to ramp up against, or wedge against, the faces to improve blocking of the mouth cavity for improved swallowing.

The bottom profile 15 of the mouthpiece may include a ridge 22 that forms on top of the bulging area and extends forwardly to become shallow towards or at the front opening 18. The ridge 22 has its most pointed peak, i.e. is sharpest, at approximately the base of the bulging area 20 as shown in sections B and C of FIG. 5(*a*). As the ridge extends up the bulge it reaches its highest point and becomes more rounded. As the ridge extends away from the bulge it becomes flatter. As the ridge nears towards the front opening 18, it transitions, in cross-section, into the curved profile of the front opening to form the elliptical, or almond-shaped opening, illustrated at section A of FIG. 5(*a*).

The bulging area 20, together with the ridge 22 if incorporated, and concaved faces 24, may form a wedge 25 that helps the tongue drive the mouthpiece inwardly of the mouth and assists in keeping the mouthpiece inside the mouth while drinking. The wedge, with the ridge and concave faces, keeps the mouthpiece snug on the tongue and the concave faces can create a suction effect on the tongue that assists in the tongue latching onto the mouthpiece to initiate the suck cycle. Towards the forward end 17 the ridge smoothes out and transitions into the elliptical or almond-shaped opening around which the tongue and palate seal for effective swallowing.

FIGS. 5(*b*) and 13(*c*), and cross-section A of FIG. 5(*a*), illustrate the elliptical or almond-shaped front opening 18 of the mouthpiece with tapering sides 42. The illustrated shape of the front opening facilitates sealing of a mouth around the mouthpiece. For example, when the hard palate and tongue converge over an object having a round cross-section (such as a standard straw) the hard palate and tongue tend to form an almond-like profile with gaps on either side of the straw that prevent effective sealing.

In contrast, having a front opening with narrow ends/sides to form an elongated round shape means the tongue need not exert as much effort on the mouthpiece as the forward end of the mouthpiece is already in its rest state substantially in, or in the vicinity of, the shape it will be during use in the mouth. This helps provide a better seal around the mouthpiece and therefore better suction through the mouthpiece.

As illustrated in the sectional views in FIGS. 5(*a*) and 13(*a*), the tapering opposing sides 42 of the mouthpiece can taper to a point. Narrow or pointed sides support the notion above of requiring less force or exertion to be applied to the mouthpiece in order to achieve a good seal. This is true for all embodiments of the mouthpiece, whether a straw/straw attachment, baby's teat or spout.

The pointed sides may be defined by having a small radius of curvature at the sides 42. Such a small radius of curvature could be less than 1.0 mm, or less than 0.5 mm or even less than 0.25 mm.

Figure 24:
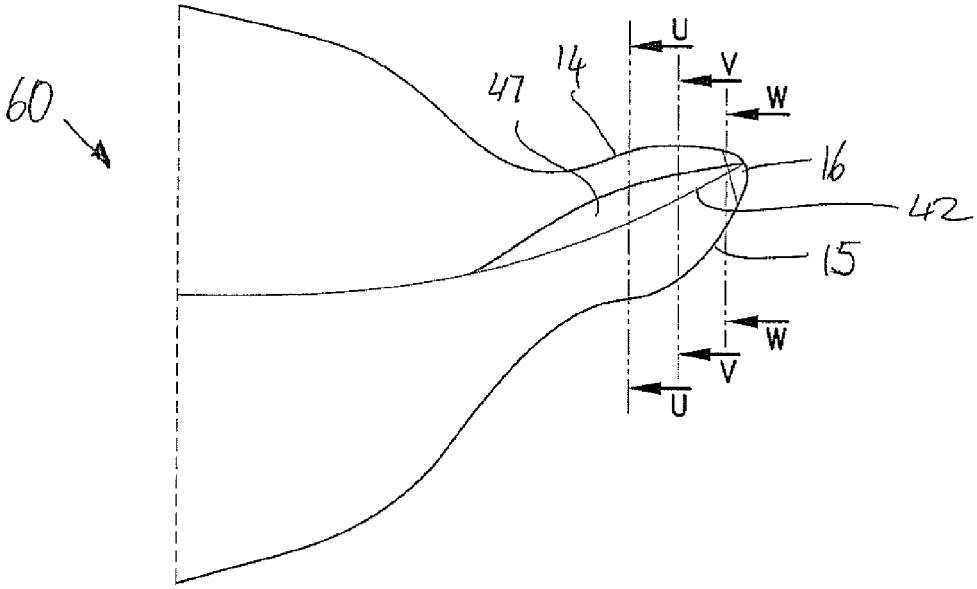
FIG. 24 is a side view of the second or fifth embodiment of the mouthpiece, and includes sections taken at U-U, V-V and W-W of the side view, the sections being shown in both an at rest state and against a baby's palate.
Figure 24:
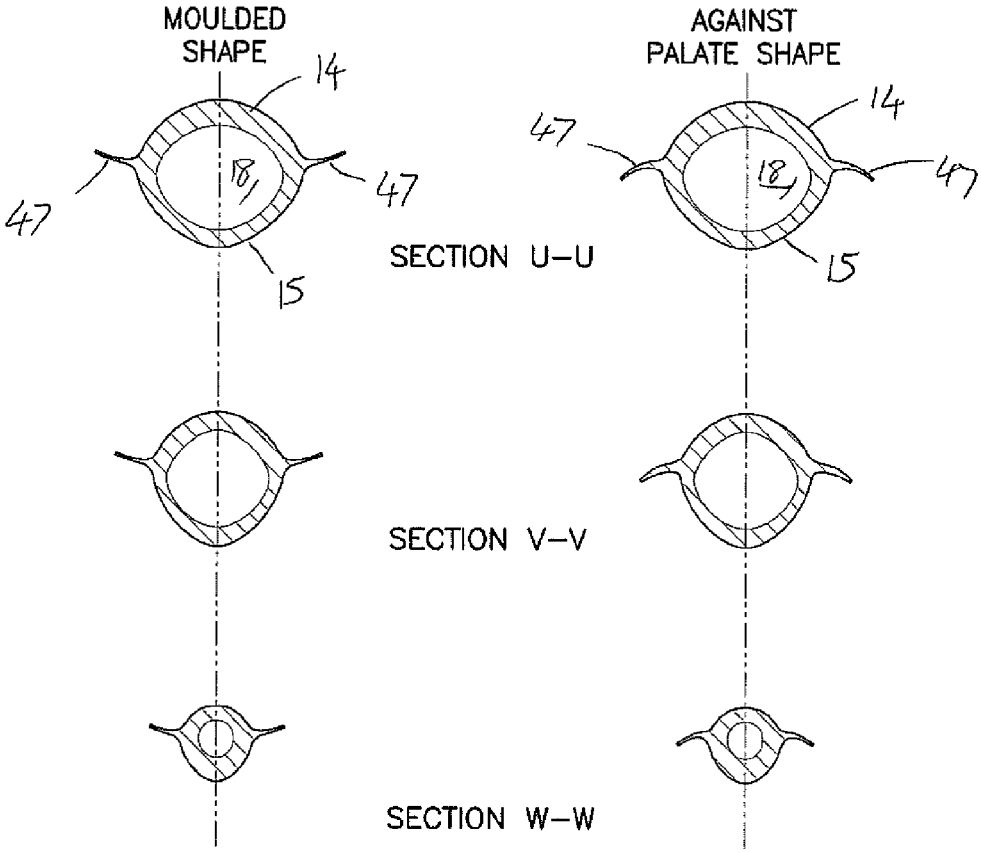
Figure 25:
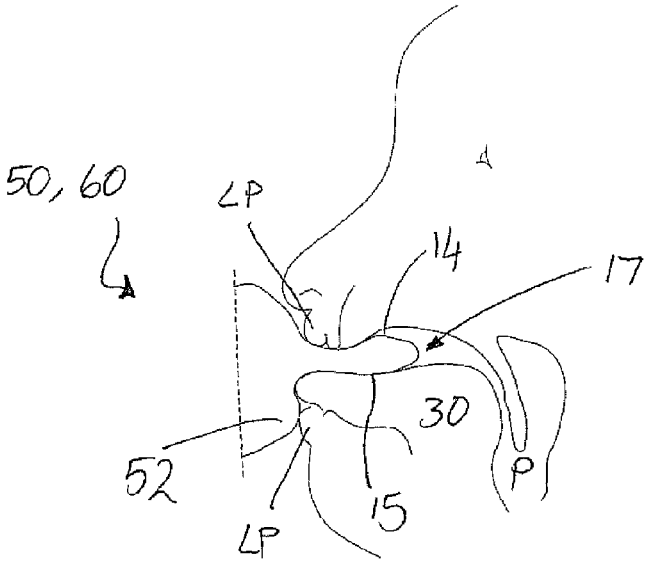
FIGS. 25, 26, 27 and 28 are a series of side sectional views of the second and fifth embodiments of the mouthpiece in a baby's mouth and which demonstrate the peristaltic wave action used to drink from the mouthpiece.
Figure 26:
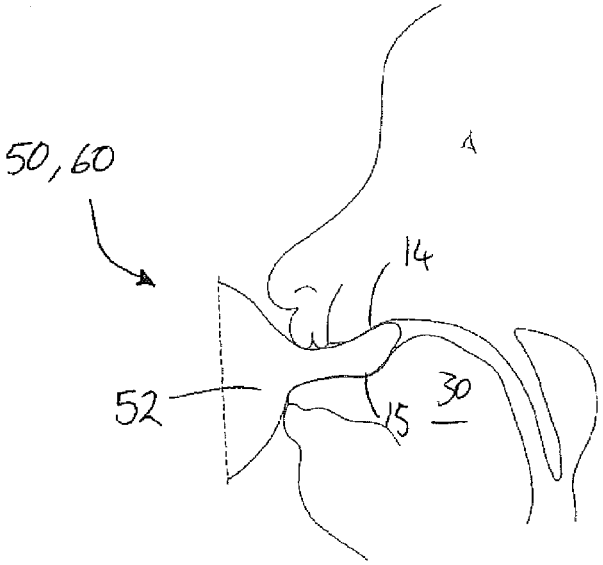
Figure 27:
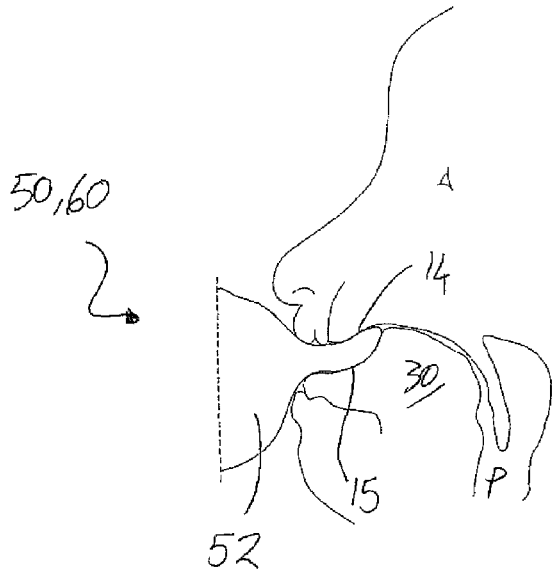
Figure 28:
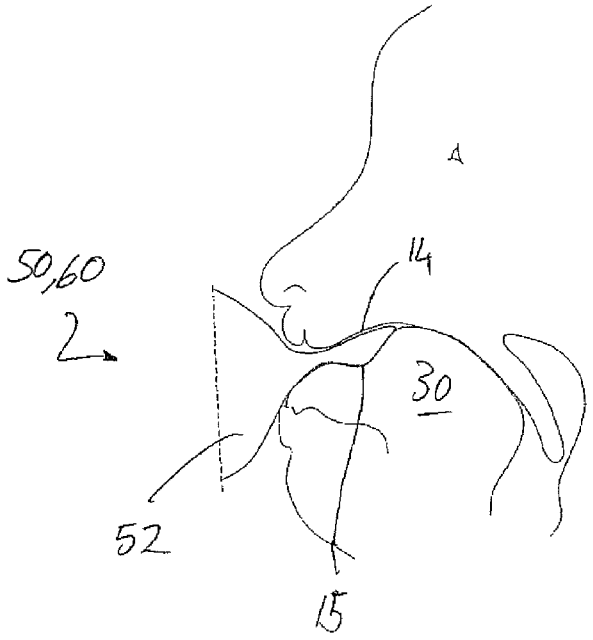

In cross section view of the drinking mouthpiece, regardless of whether the form is as a straw attachment, teat or otherwise, the curvature of the upper profile 14 is less pronounced and flatter than the curvature of the bottom profile 15. Hence, the radius of curvature of the upper profile 14 is greater than the average radius of curvature of the lower profile 15. For example, FIGS. 14(*a*), 14(*b*) and FIG. 24 illustrate a straw attachment and a teat in front sectional views where it can be seen that the upper profile 14 is substantially flatter and shorter than the lower profile 15.

Put another way, a larger proportion of the drinking mouthpiece is located below a line of demarcation defined by the opposed sides 42, so a bulk of the mouthpiece can be gripped and worked by the tongue while the upper profile can conform closely to the upper palate. This is more pronounced in the teat than the straw attachment.

The tip 16 of the mouthpiece, whether in the embodiment of the straw attachment or the teat, or any other form not shown, may taper toward the front opening 18. Again, this assists in sealing the forward end during swallowing. The angle of taper may be between 10°-20°, and more specifically between 15°-17°. The tip 16 is also compressible by the tongue to close front opening 18 and aid the swallowing action.

It is understood that the term "seal" does not necessarily mean that an air and fluid tight seal is produced at all times. Rather, a seal is produced substantially closing the gaps between the forward end and the surrounding mouth so as to improve a user's sucking action and substantially avoid entrainment of air.

Figure 14:
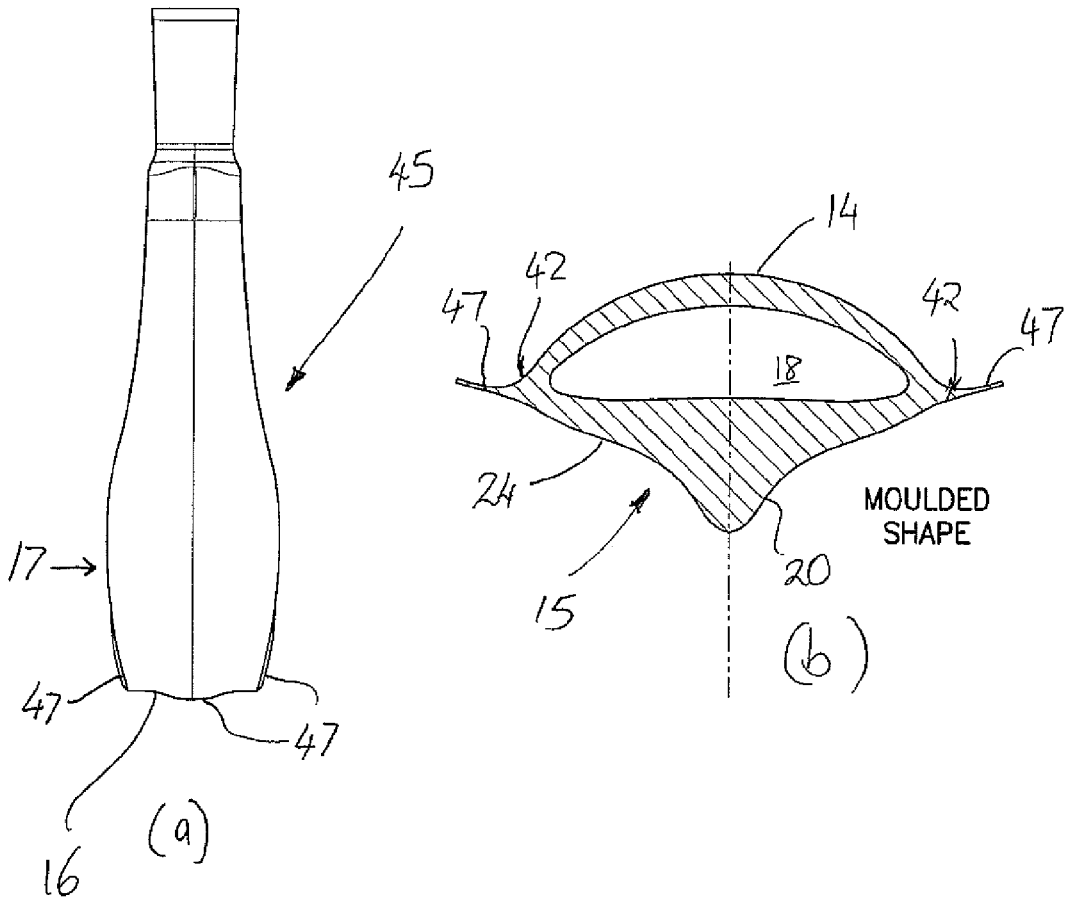
FIGS. 14(*a*) and 14(*b*) illustrate a plan view and a front view respectively of the mouthpiece of the third embodiment.

FIGS. 14(*a*) and (*b*) and 15(*a*) and (*b*) illustrate yet another embodiment of the mouthpiece which is again a straw attachment 45, having many of the features found with the first straw attachment 10 and short straw attachment 40, but differs in that the opposite sides 42 of straw attachment 45 taper into flanges 47 at the forward end 17 of the mouthpiece. Flanges 47 are flexible and are generally moulded with the mouthpiece but could be separately attached thereto.

There may also be provided, as illustrated in FIG. 14(*a*), a flange 47 overhanging the tip 16 of the straw attachment 45. The flanges may be tapered or curved as shown, or may be shaped as desired to provide improved conformance of the mouthpiece in the mouth.

The flanges 47 are an extension of the tapering sides 42 or tip 16 and may be short extensions or longer extensions, but are intended to provide additional sealing benefits between the tongue and the upper palate. FIG. 14(*b*) illustrates the cross profile of the forward end 17 in an at-rest state before insertion in the mouth. In this state the flanges are slightly upturned.

Figure 15:
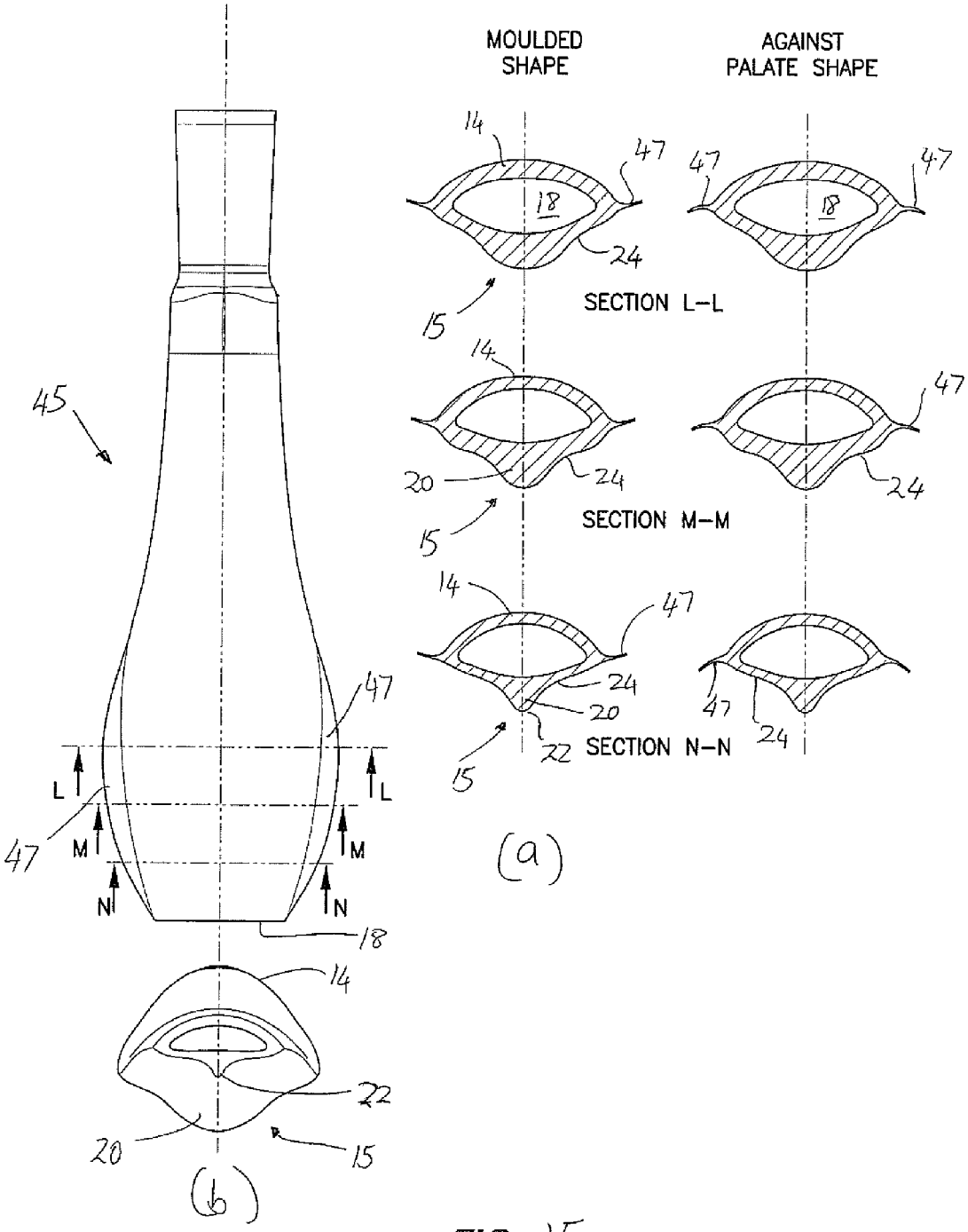
FIGS. 15(*a*) and 15(*b*) are plan and front views of a fourth embodiment of a drinking mouthpiece, and include sectional views taken at sections L-L, M-M and N-N of FIG. 15(*a*)

FIG. 15(*a*) shows sections L, M and N in a left hand column to represent the at-rest state of the straw attachment 45, while the sections illustrated in a right hand column are the cross profiles during use in the mouth. In the use state the flanges 47 bend to conform with the profile of a tongue apply a sealing force against the palate. It is noted that upper (or top) profile 14 of the mouthpiece can flex as appropriate to conform with the shape of the upper palate, while the lower (or bottom) profile 15 remains in substantially the same profile but is compressed at the tip during the swallowing action. Overall, the mouthpiece experiences a slight broadening in a lateral direction as a result of the tip being clamped shut in the mouth for swallowing.

As shown in the plan view of FIG. 15(*a*), in this embodiment flanges 47 extend substantially along the length of the forward end 17, beginning behind the bulging area 20 and extending to the tip 16 where they taper to terminate at the front opening 18.

It is also useful to note in FIGS. 14(*b*), (*c*) and 15(*a*), the thinning or coning of the bulging area 20 as it transitions towards the front opening 18 and the dished nature of the concaved faces 24 between the bulging area 20 and opposing sides 42.

FIGS. 8, 9, 10, 16 and 17 illustrate the position of the straw attachments 10, 40, 45 on the tongue and inside the mouth.

Figure 8:
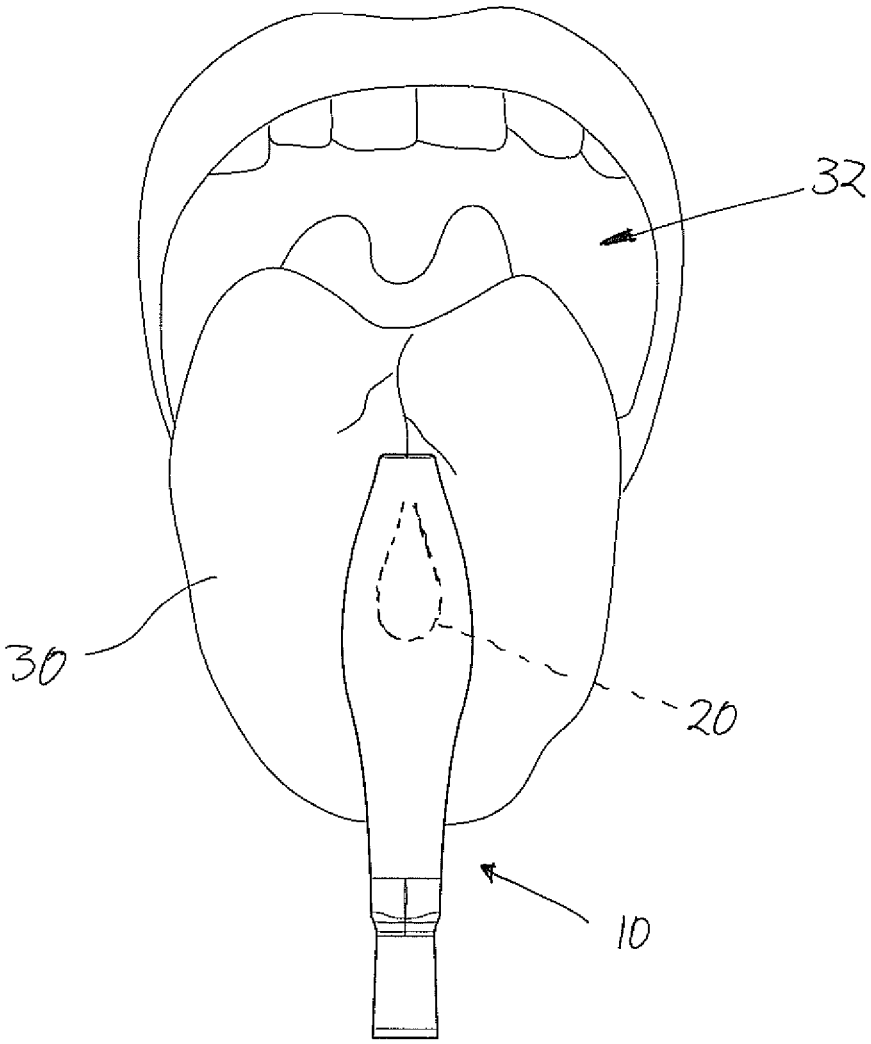
FIG. 8 illustrates a mouthpiece of the first embodiment in position on a tongue.

FIG. 8 illustrates the bulging area 20 (shown in dashed line) is placed against a middle region, and a natural recess, of the tongue 30. With the bulge 20 firmly positioned in a central recess of the tongue 30, the mouthpiece will remain in that position throughout the tongue's movements during drinking or feeding.

Figure 16:
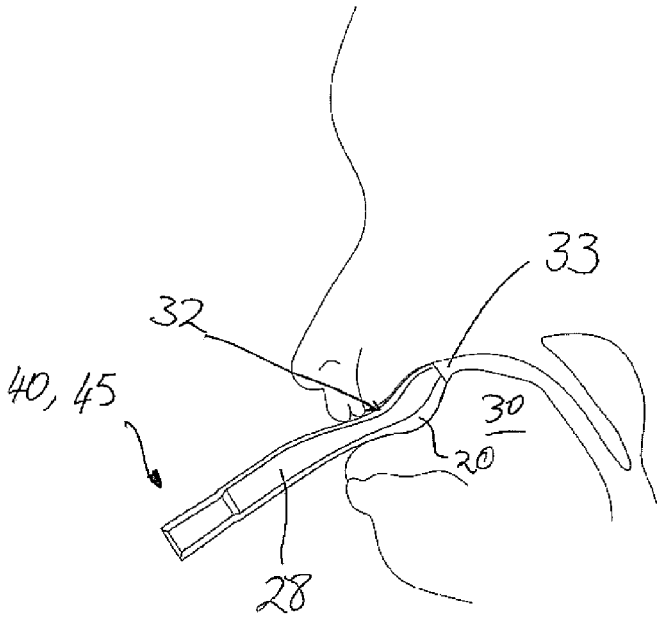
FIGS. 16 and 17 are a series of side sectional views showing the mouthpieces of the third and fourth embodiments inside a mouth, which demonstrate a swallowing action.
Figure 17:
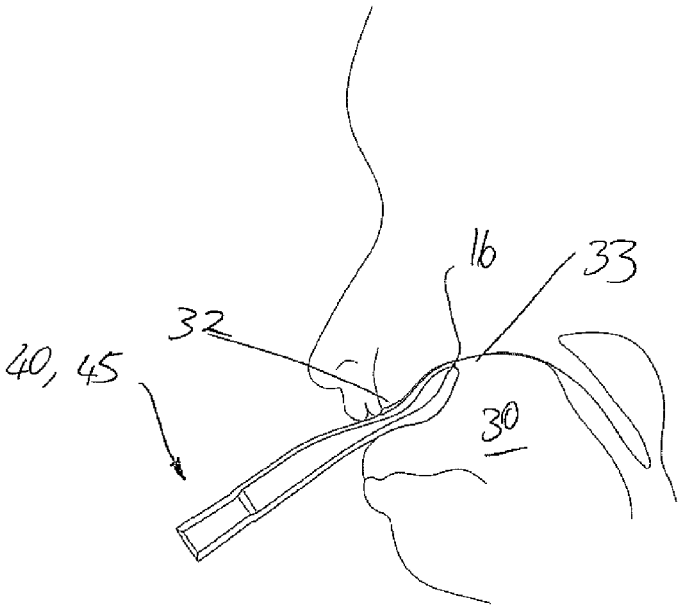

FIGS. 9 and 10, and separately FIGS. 16 and 17, illustrate a sequence of movement of the mouth with the straw attachment 10, 40, 45 inside a mouth 32 and extending to a posterior of the mouth 33. The top profile 14 has a trough 35 then a rise 36 towards the forward end 17 of the mouthpiece in order to conform to the upper hard palate of the mouth and specifically to mate with the alveolar ridge in the hard palate. Because the top profile 14 is contoured to fit against the hard palate, minimal further effort is required by the user to conform the mouthpiece to the palate for adopting a suitable drinking configuration. Rather, the user's tongue can focus full energy in drawing fluids through the mouthpiece.

FIGS. 9 and 16 both illustrate the drawing in or suction of fluid into the mouth, while FIGS. 10 and 17 illustrate the swallowing action and a compression of the tip 16 of the straw attachment.

As discussed previously, bottom profile 15 of the mouthpiece conforms to the shape of the tongue with the bulge 20 sitting in a natural central recess or dip in the tongue. This is where objects tend to nestle and can be found in the area where the Median Sulcus of the tongue begins at the front of the tongue. The resilient nature of the material of the mouthpiece further enables the top and bottom profiles to conform with their respective parts of the mouth. However, despite this resilient characteristic the top and bottom profiles of the mouthpiece are contoured such that at rest they substantially correspond with the shape of the palate and tongue of a typical user without significant stretching or moulding.

FIGS. 2, 3, 18(*a*)-30 illustrate teats 50, 60 for feeding babies. It is understood that the drinking teats may also be used, and sized accordingly, for feeding young children.

Teats 50, 60 comprise many of the same features as the straw attachments described above including an upper and lower contoured profile 14, 15, tapered opposing sides 42 and a bulging area 20. Where features of the teats are the same as those of the straw attachments, the same part numbers are used.

On the whole, the teat 50, 60 is more rounded or bulbous in shape than the straw attachment as can be seen by FIGS. 18(*a*) and (*b*) and the lateral cross sectional views of FIG. 24.

Figure 22:
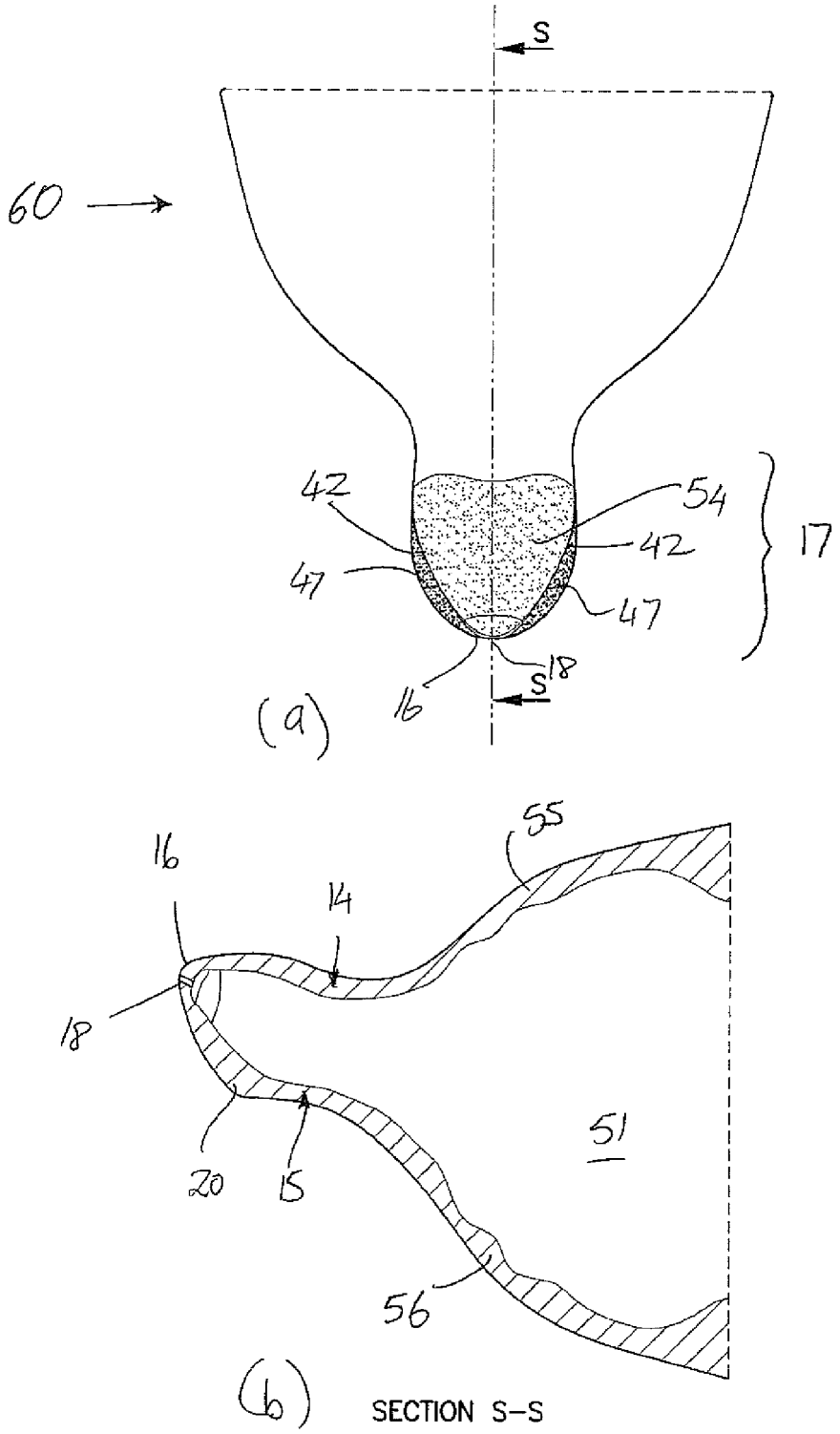
FIGS. 22(*a*) and 22(*b*) are respectively plan views and side sectional views of the fifth embodiment of the mouthpiece.
Figure 23:
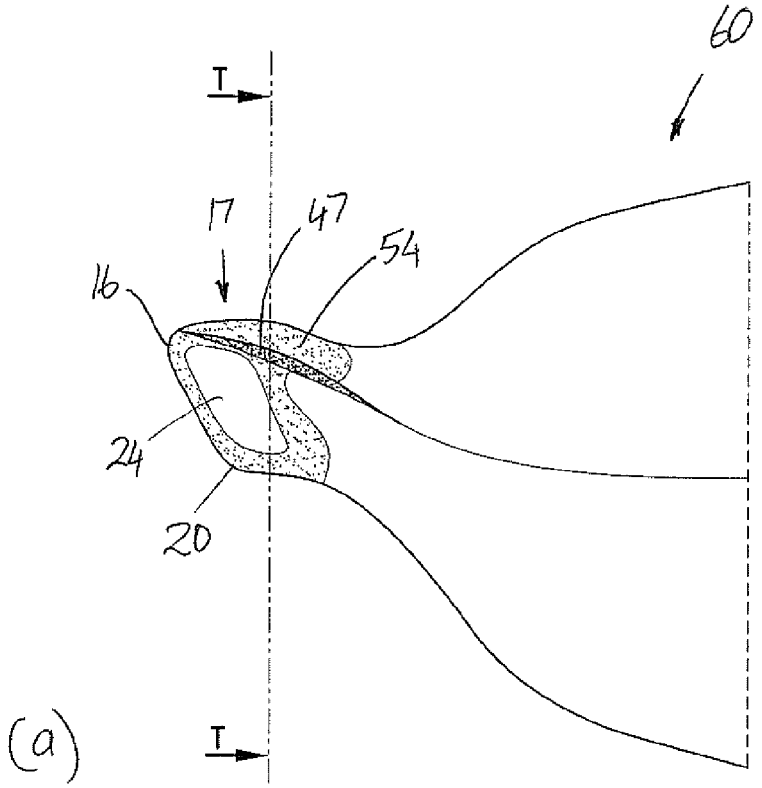
FIGS. 23(*a*) and 23(*b*) are respectively a side view of the fifth embodiment of the mouthpiece and a front sectional view taken at section T-T of FIG. 23(*a*)
Figure 23:
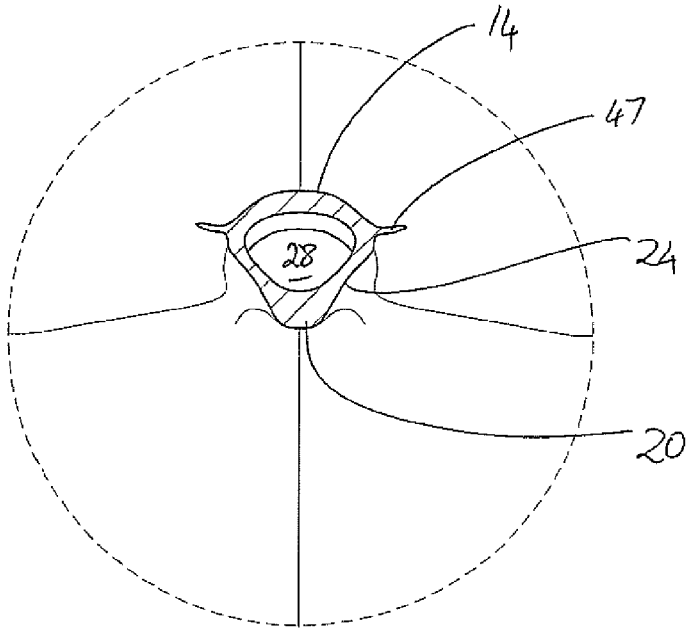

Teats 50 and 60 differ from each other in that teat 60 illustrated in FIGS. 22 to 24 has side flanges 47, similar to those of flanged straw attachment 45 described above. In particular, FIG. 24 illustrates the flexible nature of the flanges 47 in turning downwardly once inside the mouth to conform to the mouth and assist in creating a seamless seal between the tongue and upper palate.

Additionally, teat 60 is shown as having textured 'grip' portions 54 on the upper profile 14 at the forward end 17 and on flanges. This gripping surface, which can be frosted, non-polished or textured, assists in the tongue purchasing the mouthpiece. The grip portions 54 may be similarly applied to the straw attachment versions of the mouthpiece.

The teat is designed to facilitate and encourage a "near natural" drinking technique. In a natural drinking technique a peristaltic wave, which propagates along the tongue, draws fluid toward the pharynx and deposits the fluid into the pharynx region of the mouth.

In the embodiments shown the teat 50, 60 comprises a domed cavity 51 and a base 52 at the rear opening 19 that is attachable to a drinking vessel or other appropriate corresponding attachment.

The teat is described herein as it would appear when the mouthpiece is substantially horizontal as shown in FIG. 18(*b*). The upper contoured profile 14 of the teat is longitudinally curved for lying against the hard palate of a baby's mouth, while the bottom contoured profile 15 is designed to rest against the tongue.

The teat 50, 60 has a tapered forward end 17 that has the advantage that unlike the bulbous rounded tips of many known teats, the pointed tip 16 facilitates the peristaltic drinking action described above, which is innate rather than the learned "pumping action". Also, the pointed tip assists the baby in forming a seal around this forward end 17 of the teat.

The forward end 17 of the teat is additionally turned upwards by about 30 degrees from the longitudinal axis of the mouthpiece. This profile assists a baby in latching on to the teat. The forward end may point upwards by up to 45 degrees.

Figure 20:
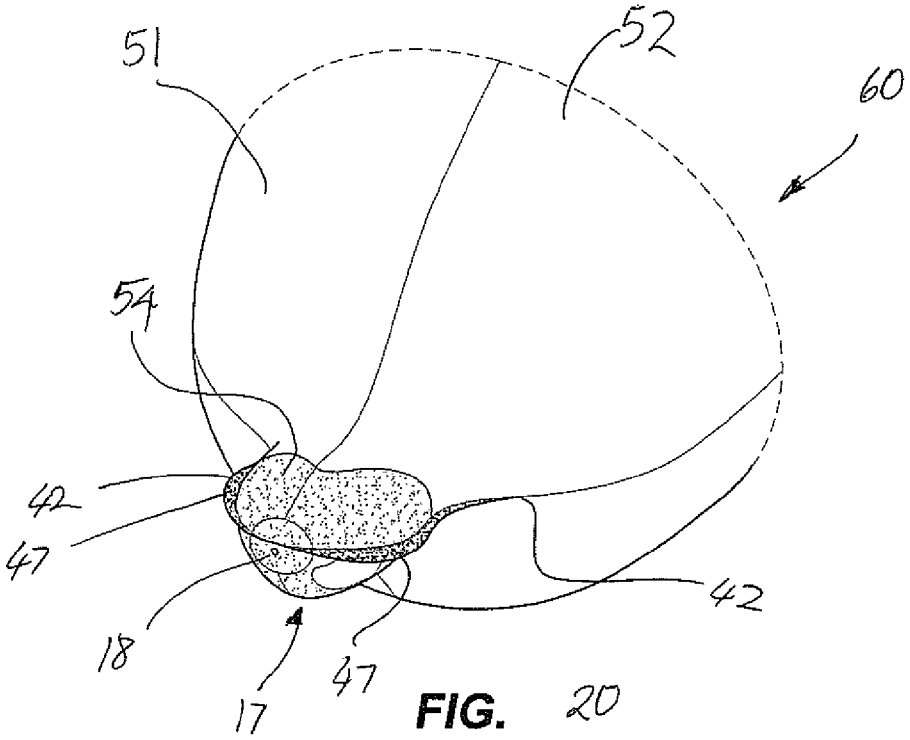
FIGS. 20 and 21 are respectively an upper perspective view and a lower perspective view of a fifth embodiment of the mouthpiece.
Figure 21:
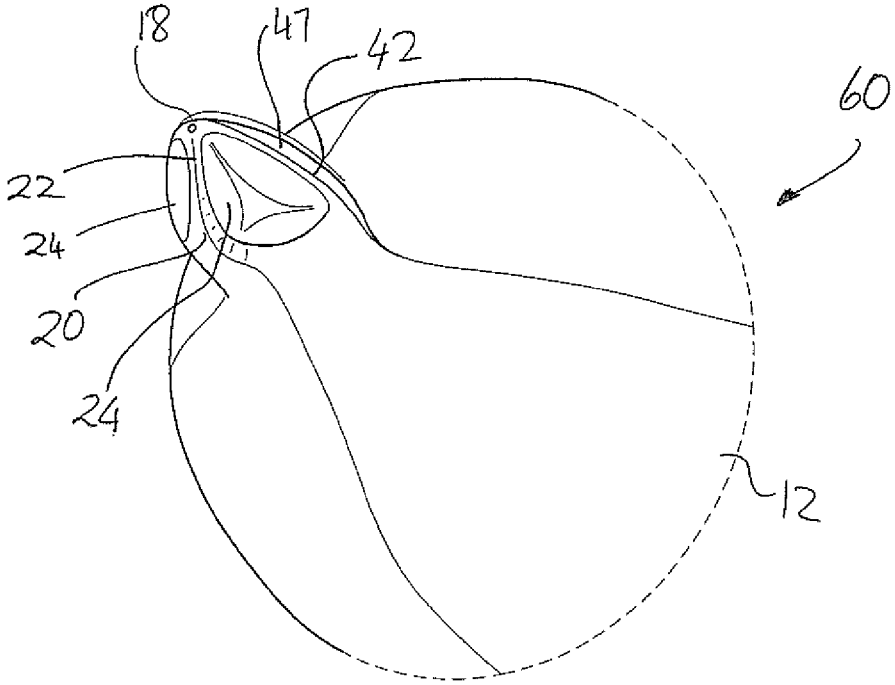

The front opening 18 is a small hole compared to the larger opening of the straw attachment and, as illustrated in FIGS. 20 and 21, the front opening 18 lies below the tapered opposing sides 42 of the forward end 17, and specifically just below the opposing sides 42 and sits at the most forward point of the teat, at the tip 16.

The teat 50, 60 is of adequate length that it extends toward the posterior of the mouth, allowing milk to be propelled into the pharynx, as is the case in natural feeding.

Figure 19:
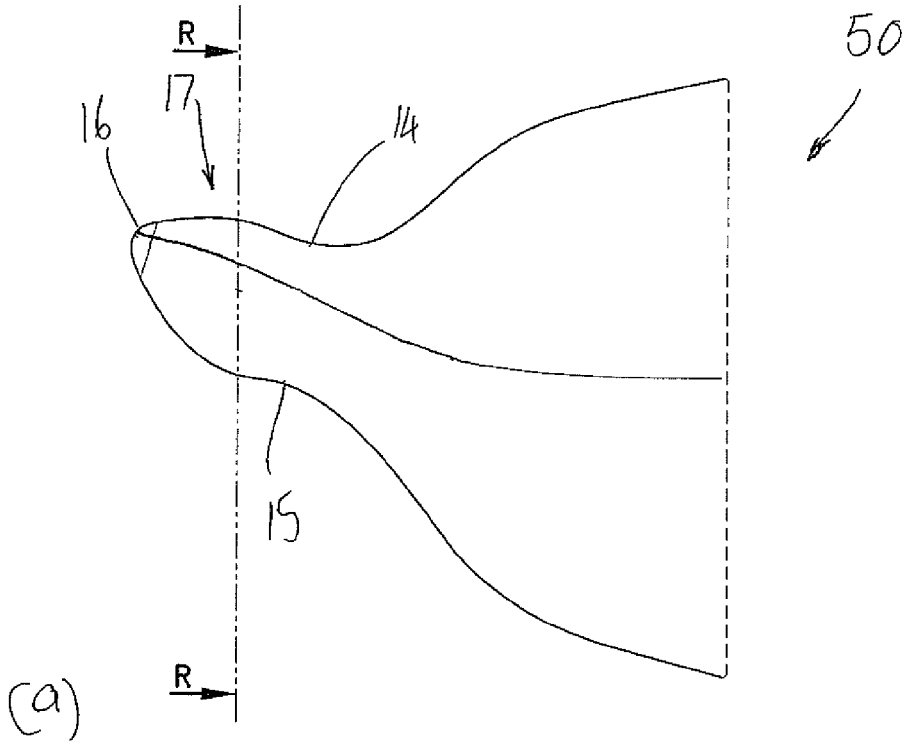
FIGS. 19(*a*) and 19(*b*) respectively illustrate a side view and a front sectional view of the second embodiment of the mouthpiece taken at section R-R of FIG. 19(*a*)
Figure 19:
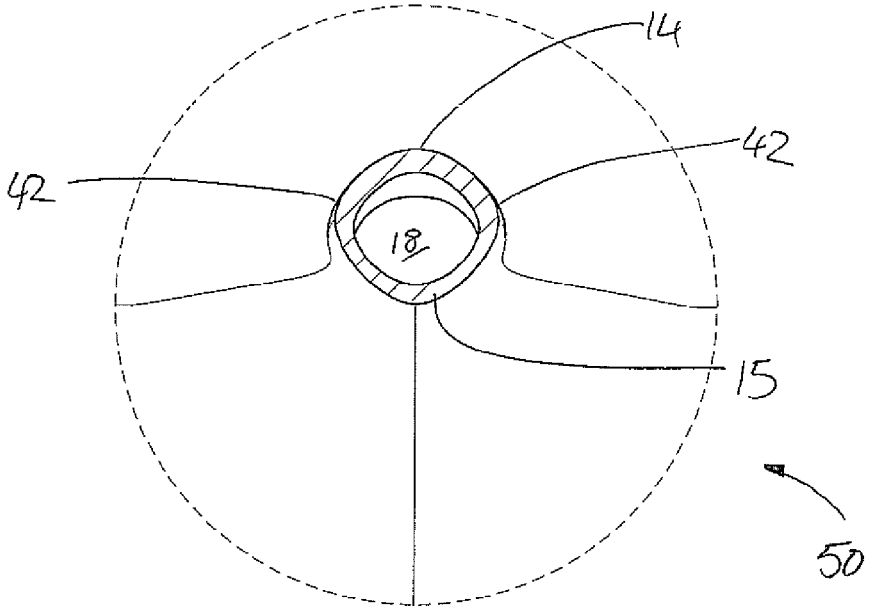

FIG. 19(*b*) shows a lateral cross section of the teat 50 taken at line R-R on FIG. 19(*a*) near to the forward end 17 of the teat 50. The upper profile 14 at the cross-section is curved to conform to and seal against the hard palate and is of a relatively constant radius of curvature. This seal assist the baby in drawing milk from the tip 20 of the teat.

The bottom profile 15 tapers downwards into the bulging area 20. That is, the radius of curvature of the bottom profile at the forward end 17 when taken lateral cross profile is significantly greater at the centre and greater than the flatter radius of curvature of the upper profile 14. As discussed previously, the greater bulk of the teat or straw/straw attachment or spout, lies below the opposing sides 42, if a line of demarcation were drawn between the opposing sides.

In addition to the benefits of the bulging area 20 described above, the bulging area 20 also reduces the likelihood of collapse or closure of the mouthpiece when pressure is applied by the tongue. This issue could arise if the bottom was flat and could easily be pressed up into the top of teat, blocking flow.

As illustrated in FIG. 23(*a*), the lower profile of the teat 50, 60 is also provided with concaved faces 24 that transition the bulging area 20 towards tapered opposing sides 42. In that figure, teat 60 also includes flanges 47.

In the plan views of FIGS. 18(*a*) and 22(*a*) it can be seen that the opposing sides 42 also taper forwardly toward the tip 16 of the teat 50, 60.

FIGS. 18(*b*) and 22(*b*) show a longitudinal cross-section of the teat along centreline Q-Q of FIG. 18(*a*) and S-S of FIG. 22(*a*). There is a variation of wall thickness in the upper 55 and lower walls 56 of the teat 50, where parts of the walls 55, 56 appear to thin out in sections. This is to provide flexibility to the domed cavity 51 to allow it to bend with the movement of the teat and/or bottle to which it is attached.

FIGS. 25 to 28 show the teat 50, 60 in position in a baby's mouth, and demonstrate the natural peristaltic wave action used to drink from the teat. The base 52 engages with the outside of the lips LP. The base 52 in combination with the contoured upper profile 14 ensures the teat sits at the correct depth in the mouth. The base 52 also allows for attachment to a milk bottle (not shown). The base 52 converges to a narrow region 53 which mates with the teeth, or gums of the user.

The top profile 14 of the teat has a rise in order to mate with the alveolar ridge in the hard palate of the user. The top profile 14 after the rise extends toward the forward end 17 in a gradual concave arc, or curve that lies against the hard palate. Because the top profile 14 is contoured to closely fit against the hard palate, minimal further effort is required by the user to conform the mouthpiece to the palate for adopting a suitable drinking position. Rather, the user's tongue 30 can focus its full energy on generating a peristaltic wave to push milk toward the pharynx P.

FIGS. 25 to 28 illustrate in series a peristaltic wave action of the tongue 30 drawing milk in the teat toward the pharynx.

The bottom profile 15 has a gentle concave to convex shape from the base 52 toward the forward end 17 that mates with the arched surface of the tongue 30. The teat rests along a significant portion of the tongue 30. This close contact along the tongue 30 facilitates the natural peristaltic wave drinking technique.

As shown in FIGS. 25 to 28, the surface of the tongue gradually pushes upwards against the forward end 17 of the teat 50 moving from the suction phase to the swallowing phase, and in turn clamping onto the forward end of the teat.

In use, the close fitting top profile 14 and bottom profile 15 will still mould somewhat in order to accommodate the variations in shape of hard palates and tongues between users. However, the top and bottom profiles of the teat are contoured such that at rest they substantially correspond with the shape of the palate and tongue 30 of a typical user without significant stretching or moulding.

The thin, compliant bottom wall 56 and pointed forward end 17 cooperate to allow a peristaltic action of suction and swallowing. The thin bottom wall ensures that the lips LP are able to effortlessly deform the resilient elongated part of the teat. Unlike a bulbous end the pointed forward end 17 offers little resistance to the peristaltic action. The pointed forward end 17 profile minimises downward pressure on the posterior of the tongue T which both assists in maintaining the required seal and also reduces the extortion required to propagate the peristaltic wave. The tip 20 has as overall radius of curvature of 1-10 mm.

The seal created in the mouth avoids air entrainment and facilitates a seal against which the user can suck to draw milk from the teat. This seal facilitates a baby to properly remain latched onto the teat. The tapered tip allows the user's tongue 30 to rest in a natural position against the position of the palate. This profile also allows the mouthpiece to stretch toward the forward end.

The forward end of the mouthpiece has one or more holes, perforations or slots through which liquid flows. The number of holes, slots, etc. and their size will vary according to the flow rate desired, which is usually dependent on the age and/or size of the baby who will use the drinking teat.

The mouthpiece 10 whether in the form of a straw attachment, a straw, a spout or a drinking teat, assists the user in drawing fluid comfortably and easily into the posterior of the mouth. In particular, this is useful for newborn babies who can only innately draw in fluid by a peristaltic wave of sucking. The drinking mouthpiece is also suitable for people who wish to reduce exposure of acid drinks to their teeth as the mouthpiece carries fluid past the front teeth but also reduces backwash at the rear teeth. The seal around the palate and sides of the mouth is very useful in reducing pooling of fluid around the molars and backwashing through the teeth.

The protrusion on the underside of the mouthpiece in the form of a bulge allows the tongue to wrap around it and identify it as a point of reference so that the tongue can keep the mouthpiece in position and pull or suck back to the posterior of the mouth so that fluids are directed towards the pharynx and do not pool around the teeth or wash back out of the mouth. The ramp nature of the concave faces additionally provides a surface for the tongue to push up against in order to block the mouthpiece for swallowing.

The tapered opposing sides, and even the forward tapering feature towards the front opening, enable the tongue to seamlessly hold the mouthpiece against the palate and gums, without having to work against broader resilient side edges that will push the tongue away from the palate and cause it to tire just to maintain a seal in the mouth. The mouthpiece makes delivery of fluids easier and more reliably than known mouthpieces, and requires less exertion by the user.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A drinking mouthpiece comprising a resilient body through which fluid flows from a rear opening through to a front opening, the body having a longitudinal upper profile contoured to substantially correspond with a portion of the palate of a mouth and a contoured longitudinal lower profile for lying against a tongue;

wherein a forward end of the body near the front opening has a profile when viewed in cross-section to a longitudinal direction of the body that narrows laterally of the body to two opposing sides of the mouthpiece, and also has a bulging area on the lower profile that provides a reference point against which the tongue can lie; and wherein the bulging area is a raised protuberance molded into the lower profile to provide a continuous surface of the lower profile that transitions to reduce in width and height toward the front opening in a partial tear-drop configuration when viewed in cross-section to the longitudinal direction of the body.

2. The drinking mouthpiece as claimed in claim 1, wherein in cross-section, the lower profile at the bulging area transitions to the narrowed opposed sides through concaved faces.

3. The drinking mouthpiece as claimed in claim 1, wherein the bulging area is contoured to nestle in the median sulcus area of the tongue.

4. The drinking mouthpiece as claimed in claim 1, wherein the front opening is located at a tip of the mouthpiece and, in the longitudinal direction of the body, the front opening is offset from the rear opening of the mouthpiece.

5. The drinking mouthpiece as claimed in claim 4, wherein the front and rear openings are offset by 2 to 8 mm.

6. The drinking mouthpiece as claimed in claim 5, wherein the front and rear openings are offset by 5 to 6 mm.

7. The drinking mouthpiece as claimed in claim 1, wherein the upper profile is shorter than the lower profile when measured between a tip of the mouthpiece and a laterally common predefined point.

8. The drinking mouthpiece as claimed in claim 1, wherein the distance between the bulging area and the front opening is approximately 3 mm to 20 mm.

9. The drinking mouthpiece as claimed in claim 1, wherein the opposing sides taper to a point.

10. The drinking mouthpiece as claimed in claim 9, wherein the point has a radius of curvature of less than 1.0 mm.

11. The drinking mouthpiece as claimed in claim 10, wherein the radius of curvature is less than 0.5 mm.

12. The drinking mouthpiece as claimed in claim 11, wherein the radius of curvature is less than 0.25 mm.

13. The drinking mouthpiece as claimed in claim 1, wherein flexible flanges are provided at the opposing sides between the bulging area and the front opening at a tip of the mouthpiece.

14. The drinking mouthpiece as claimed in claim 13, wherein the flanges are slightly upturned and are provided substantially along the entire length of the opposing sides between the bulging area and the front opening.

15. The drinking mouthpiece as claimed in claim 3, wherein a ridge is provided along the top of the raised protuberance.

16. The drinking mouthpiece as claimed in claim 1, wherein the drinking mouthpiece is a teat or a spout or a straw or an attachment for a straw.

17. The drinking mouthpiece claimed in claim 16, wherein as a teat, the lower profile in cross-section of the teat between the opposing sides is substantially larger than the upper profile.

18. The drinking mouthpiece as claimed in claim 16, wherein the front opening includes one or more small apertures located at the forward end of the body.

19. The drinking mouthpiece claimed in claim 16, wherein as a teat or attachment for a straw, the mouthpiece is provided at the rear opening with an attachment profile to respectively attach to a bottle or a straw.

20. The drinking mouthpiece as claimed in claim 1, wherein the bulging area is defined by a thickening of the material of the resilient body.

* * * * *